US009687751B2

(12) United States Patent
Peckham

(10) Patent No.: US 9,687,751 B2
(45) Date of Patent: Jun. 27, 2017

(54) BUBBLE GENERATING ARTICLE

(71) Applicant: Samuel Peckham, East Haddam, CT (US)

(72) Inventor: Samuel Peckham, East Haddam, CT (US)

( * ) Notice: Subject to any disclaimer, the term of this patent is extended or adjusted under 35 U.S.C. 154(b) by 306 days.

(21) Appl. No.: 14/339,941

(22) Filed: Jul. 24, 2014

(65) Prior Publication Data

US 2015/0031264 A1 Jan. 29, 2015

Related U.S. Application Data

(60) Provisional application No. 61/858,267, filed on Jul. 25, 2013.

(51) Int. Cl.
*A63H 33/28* (2006.01)

(52) U.S. Cl.
CPC ..... *A63H 33/28* (2013.01)

(58) Field of Classification Search
CPC ..... A63H 33/28; A63H 33/3038
USPC ..... 446/15, 153; 4/661, 294, 295
See application file for complete search history.

(56) References Cited

U.S. PATENT DOCUMENTS 2,032,192 A * 2/1936 Wheeler, Jr. ..... A63H 23/10 40/408
2,247,311 A * 6/1941 Rockwood ..... E03C 1/084 239/428
2,435,449 A * 2/1948 Kubacki ..... A47K 5/14 261/116
2,517,539 A * 8/1950 Brown ..... A45D 27/12 239/311
2,699,357 A 1/1955 Roth
3,079,093 A 2/1963 Bellows
3,226,034 A 12/1965 Heiman
3,246,419 A * 4/1966 Pawelka ..... A63H 23/06 446/163
3,367,325 A 2/1968 O'Keefe
3,577,675 A * 5/1971 Kohner ..... A63H 23/10 446/177
3,607,779 A * 9/1971 King ..... A62C 3/0207 169/14
3,614,244 A 10/1971 Eck
3,913,260 A * 10/1975 Corbett ..... A63H 33/28 446/16
4,004,302 A 1/1977 Hori
4,322,036 A 3/1982 Bly
4,742,584 A 5/1988 Abe
(Continued)

*Primary Examiner* — Vishu Mendiratta

(57) ABSTRACT

A bubble generating article is provided and includes a soap dispensing device, an agitation device having a plurality of paddles which are configured to rotate about an axis and an article structure, wherein the article structure defines a water receiving cavity and a soap receiving cavity. The water receiving cavity is configured to receive water from a water faucet, and the soap receiving cavity is configured to receive bubble soap from the soap dispensing device. Additionally, the water receiving cavity and soap receiving cavity are in flow communication with the agitation device such that water flowing into the water receiving cavity and soap flowing into the soap receiving cavity, contact at least a portion of the plurality of paddles, wherein the plurality of paddles rotate about the axis to cause the water and soap to mix.

10 Claims, 30 Drawing Sheets

(56) References Cited

U.S. PATENT DOCUMENTS 4,775,348 A * 10/1988 Collins ..... A63H 33/28 446/15
4,907,305 A * 3/1990 Teramachi ..... A61H 33/6063 137/171
4,957,101 A 9/1990 Hara
4,984,313 A 1/1991 Hara
5,080,091 A 1/1992 Peterson et al.
5,143,295 A 9/1992 Okayama et al.
5,197,153 A 3/1993 Hara
5,274,858 A 1/1994 Berry
5,456,201 A * 10/1995 Bobst ..... B63B 1/38 114/222
5,567,127 A 10/1996 Wentz
5,643,035 A 7/1997 Freese et al.
5,720,876 A 2/1998 Mackrle et al.
6,119,286 A 9/2000 Briscoe
6,281,177 B1 * 8/2001 Moriyama ..... A61K 8/34 510/130
6,406,446 B1 6/2002 Takagi et al.
6,409,099 B1 6/2002 Goodwin et al.
6,729,564 B2 5/2004 Srinath et al.
7,261,283 B1 8/2007 Ohnari
8,074,305 B2 12/2011 Matsuda
8,186,653 B2 5/2012 Tsuji
8,322,634 B2 12/2012 Cunningham et al.
8,371,514 B2 2/2013 Finell
2011/0306265 A1 12/2011 Mor
2013/0034829 A1 2/2013 Choi
2013/0326804 A1 * 12/2013 Autry ..... A47K 3/001 4/559

* cited by examiner

Section A-A

BUBBLE GENERATING ARTICLE

CROSS-REFERENCE TO RELATED APPLICATIONS

The present application claims priority to U.S. Provisional Patent Application Ser. No. 61/858,267, entitled "A Bubble Generating Article", filed on Jul. 25, 2013, the content of which is incorporated herein by reference in its entirety.

FIELD OF THE INVENTION

This invention relates generally to an article for generating bubbles and more particularly to an article for generating bubbles within a bathtub using water that flows from the bathtub faucet.

BACKGROUND OF THE INVENTION

Bubble baths are well known and are very popular among children and adults. Unfortunately, it is actually very difficult to generate a bubble bath that has a large amount of luxurious bubbles similar to that seen in movies. Thus, there are a large number of devices that are made specifically for generating bubbles in a bathtub. These devices range from devices that mix the bubble generating catalyst with the water coming out of the faucet (See for example U.S. Pat. No. 8,371,514 to Finell and U.S. Pat. No. 3,079,093 to Bellows) to devices that use a motor to agitate the water and soap to produce bubbles. These devices are disappointing because they rarely result in a bubble bath have a maximum number of bubbles and inefficiently waste bubble soap and/or rely on the ongoing use of battery power.

Other ways to generate bubbles are used as well and many don't use special devices. For example, one way to generate bubbles is to run the bath faucet and pour the bubble generating catalyst directly into the agitated area caused by the faucet. Unfortunately however, because the catalyst is rarely poured into the faucet stream where a maximum number of bubbles would be generated, this results in a large amount of bubble bath catalyst being wasted. Furthermore, in all of the above devices and ways to generate bubbles mentioned above, the bubbles that are generated are reduced because they interact with the faucet stream which bursts the bubbles as soon as they are created.

Accordingly, current methods and devices are very inefficient and result in wasted bubble bath catalyst as well as generating baths that have a low level of bubbles relative to the bath size.

SUMMARY OF THE INVENTION

In one embodiment, a bubble generating article is provided and includes an article structure, wherein the article structure defines a water receiving cavity, a soap receiving cavity and a mixing section, wherein the mixing section is communicated with both the water receiving cavity and the soap receiving cavity. The bubble generating article includes a first opening communicated with the water receiving cavity, wherein the first opening is configured to receive water from a water faucet, a second opening communicated with the soap receiving cavity and a structure outlet communicated with the mixing section. The bubble generating article further includes a soap dispensing device communicated with the second opening and configured to dispense soap into the soap receiving cavity and an agitation device having a plurality of paddles that are configured to rotate about an axis, wherein the agitation device is located proximate the structure outlet to be at least partially within the mixing section. Additionally, a structure support is also included, wherein the structure support is configured to float on water and support the article structure such that only a portion of the agitation device is located within the water, wherein when water is received into the water receiving cavity, the water flows into the mixing section to contact the agitation device to cause the plurality of paddles to rotate, and wherein when the soap dispensing means is dispensing soap, the soap is directed to contact at least a portion of the rotating paddles.

In another embodiment, a bubble generating article is provided and includes a soap dispensing device, an agitation device having a plurality of paddles which are configured to rotate about an axis and an article structure, wherein the article structure defines a water receiving cavity and a soap receiving cavity. The water receiving cavity is configured to receive water from a water faucet, and the soap receiving cavity is configured to receive bubble soap from the soap dispensing device. Additionally, the water receiving cavity and soap receiving cavity are in flow communication with the agitation device such that water flowing into the water receiving cavity and soap flowing into the soap receiving cavity, contact at least a portion of the plurality of paddles, wherein the plurality of paddles rotate about the axis to cause the water and soap to mix.

A method for generating bubbles using a bubble generating article is provided, wherein the bubble generating article includes a water receiving cavity, a soap receiving cavity, a soap dispensing device and an agitation device. The method includes configuring the soap dispensing device such that bubble soap is located within the soap dispensing device and such that the bubble soap is being dispensed from the soap dispensing device into the soap receiving cavity, and locating the bubble generating article within a bathtub having a water faucet and containing some water such that the bubble generating article is floating on the water. The method further includes positioning the bubble generating article such that water flowing from the water faucet is flowing into the water receiving cavity, where the water flows out of the water receiving cavity to cause the agitation device to mixingly combine the water and bubble soap.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike:

FIG. 20D illustrates a front view of the bubble generating article having a single hull which is rounded, in accordance with still yet another embodiment.

DETAILED DESCRIPTION OF THE INVENTION

Figure 1A:
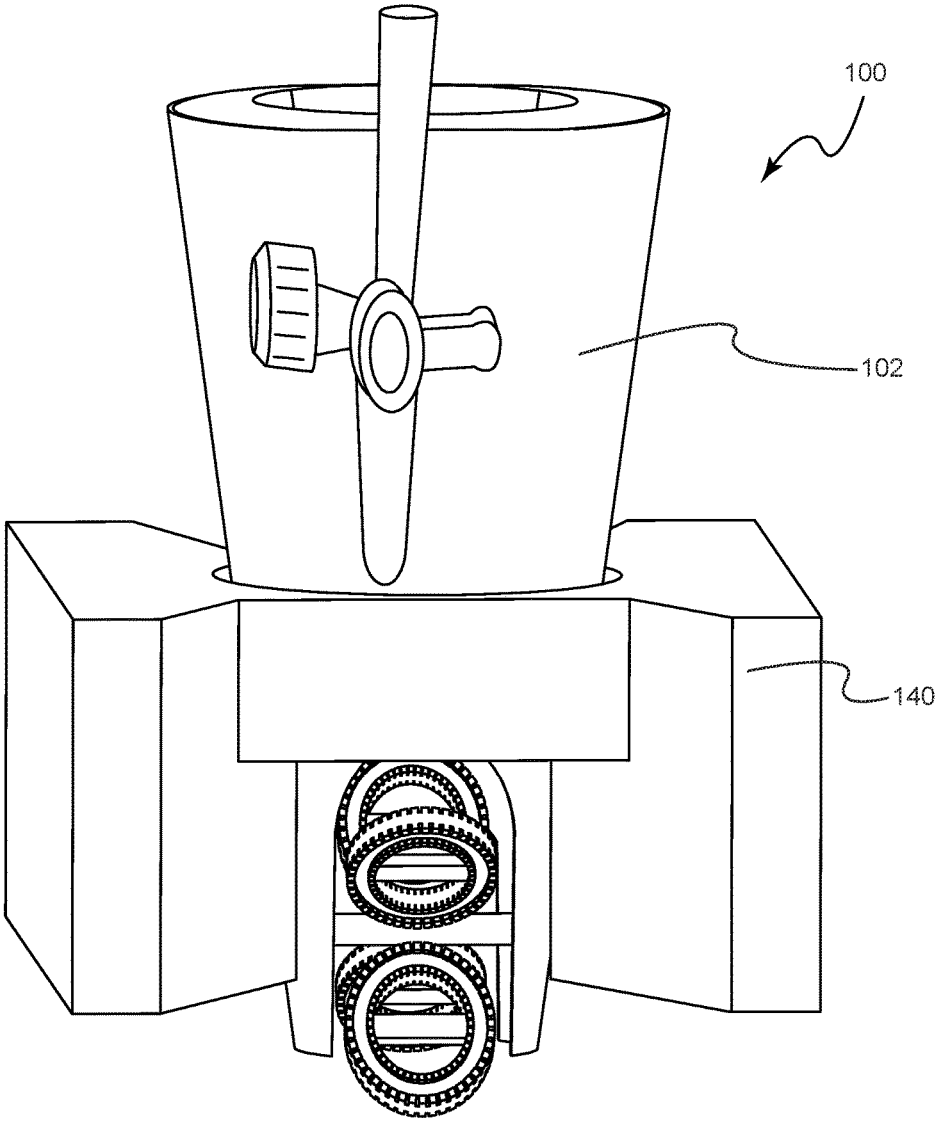
FIG. 1A is a front view of a bubble generating article showing an article structure and a structure support, in accordance with one embodiment of the invention.

It should be appreciated that the present invention provides a bubble generating article to create bubbles for a bath. Essentially the bubble generating article focuses and combines churning water, air and the optimum amount of bubble catalyst (i.e. bubble bath soap) in the same general area. By directing a stream of bubble soap into an agitation and aeration mixing area, where the bubble soap/water/air mixture is churned by a rotating paddle wheel, more bubbles are created than the conventional method of pouring in bubble soap near or underneath the flow of water from the faucet. It is contemplated that the bubble generating article is sized to be positioned under the flow of a faucet of a household bath. It has a substantially funnel shaped receiver that ensures the article is always positioned at the center of the flow of falling water, where if the article starts to float away from the stream of falling water, the force of the falling water against the angled inner wall of the funnel shape receiver pushes the article back to under the flow of falling water from the bath faucet. Additionally, the funnel shaped receiver directs the flow of water to the specific place where the metered bubble soap is being dispersed in an agitation and aeration area. Generally, at the bottom of the receiver is a rotating paddle wheel that uses the kinetic energy from the falling water as its power source to rotate the paddle wheel to agitate and aerate the soap/water/air mixture thus creating bubbles. The article is buoyant, thus ensuring constant optimum position of the rotating paddle wheel (i.e. the axle of the paddle wheel is right below the water line). The soap/water/air mixture is loosely contained in an agitation and aeration mixing area by the rotating paddles (which may also create a circular current of churning water that helps to create bubbles) and/or by the side walls of a support device and/or article structure. This advantageously keeps the bubble soap and churning water in the same place for more time than if soap were just randomly added to the bath water and creates more agitation and aeration time, thus more bubbles.

It should be further appreciated that the rotating paddle wheel creates a small current that carries bubbles through the first outlet opening and the second outlet opening (i.e. bubble escape ports) away from the bubble generation article, thus filling the tub with bubbles and allowing space for new bubbles to be made in the agitation and aeration mixing area. If bubbles were created in a sealed space the bubbles would compress on each other and collapse, resulting in a small amount of bubbles. By creating a current that carries the bubbles away from the bubble generation article, the bubbles are prevented from compressing each other and collapsing. Because the article is configured and sized to fit in the center space underneath the falling bath faucet water, it is also sized appropriately to be handled and played with by a child, thus adding value and function to this device as a child's toy.

The article can be easily taken out of the tub like any other bath toy. The bubble soap metering (titrating) valve (i.e. bubble catalyst device) delivers exactly and only the amount of bubble soap desired in a controllable fashion. The bubble soap metering valve can be easily shut off to ensure no soap spills during storage and can be stored in the bubble catalyst device. Also, because of the shape of the article, the article can be easily and thoroughly air dried, thus preventing mold growth during storage. Creating bubbles requires a certain threshold amount of bubble soap. Metered control of bubble soap dispersal ensures the minimum amount of bubble soap is used without wasting excess bubble soap. The conventional method of pouring in bubble soap into the bath actually has small currents of water that carry un-agitated soap away from the falling water of the faucet, thus resulting in unused bubble soap. This inefficiency is corrected by a metered bubble soap delivery device. Creating bubbles also requires an egress of bubbles from the site of agitation and aeration otherwise the bubbles would compress on each other and collapse. The small current generated from the paddle wheel which passes through bubble escape ports in the agitation and aeration mixing area allow for this.

Accordingly, it should be appreciated that the agitation device (paddle wheel) is configured to create agitation and aeration of bubble soap and water in the agitation and aeration bubble mixing area (i.e. the area of maximum agitation and aeration). This is because the rotation of the paddle wheel creates a current that propels some bath water and the bubbles that float on top of that bath water away from the bubble generation article. It should be further appreciated that the fins/channels/grooves on the surface of the paddles on the paddle wheel, along with the openings in the paddles, capture bubble soap and/or act to create extra agitation and aeration. The rotating fins/channels/grooves also capture and submerse small quantities of air into the mixing area. This submersed air adds to the aeration component of the agitation and aeration necessary to generate bubbles. This is discussed further with regards to FIG. 3C. Moreover, the funnel shape of the article structure that receives water from the bath faucet ensures the flow of falling water reaches the agitation and aeration mixing area. If the device is moved or jostled by splashing water from bathing children the funnel shape receiver directs the device back into alignment directly under the flow of falling water from the faucet.

Additionally, the device is "powered" by the kinetic energy of the falling (and/or pressurized) water (i.e. water pressure) and thus requires no battery powered electric motor (or other power source, such as a hand crank to operate). Furthermore, the agitation and aeration mixing area is a partially open area that includes bubble escape ports on the front and back of the article that allow bubbles to be directed out of the mixing area and distributed into the bathtub. The closed side walls of the agitation and aeration mixing area are necessary to contain agitated water and bubble soap to allow for more mixing time to generate bubbles. Once the bubbles have been generated the open areas in the front and rear of the mixing area are used to allow bubbles to escape.

In accordance with one embodiment of the invention, the bubble soap may be dispersed directly by a tube into the precise area of maximum agitation and aeration (i.e. the agitation and aeration mixing area). For example, in one embodiment, the bubble soap is contained in a reservoir or a syringe like distribution device and directed through a metering device (such as a ball valve or roller clamp) out of the distribution device thereby allowing the user to control how much soap is actually distributed to the bath. This advantageously allows the distribution device to be 'closed' to allow the distribution device to be stored while still containing bubble soap in the soap reservoir. This allows the device to be stored in any position without having soap leak out which permits easy storage.

Furthermore, it is contemplated that the bubble generating article, aside from being used as a toy, can also be used to disperse liquid aromatherapy products or any liquid bath soap product or any other type of bath product (liquid or non-liquid), such as moisturizers for adults and/or children. Moreover, in another embodiment the bubble generating article may be easily adapted to disperse solid bath salts as well. It is also contemplated that the bubble generating article can be shaped as a toy, such as a toy boat, a toy animal (like a rubber duck) or a toy fish (like a whale). Accordingly, the bubble generating article has two functions. First, it creates more bubbles than soap alone and second, it functions as a bath toy that can be used after bubbles have been made.

Figure 1B:
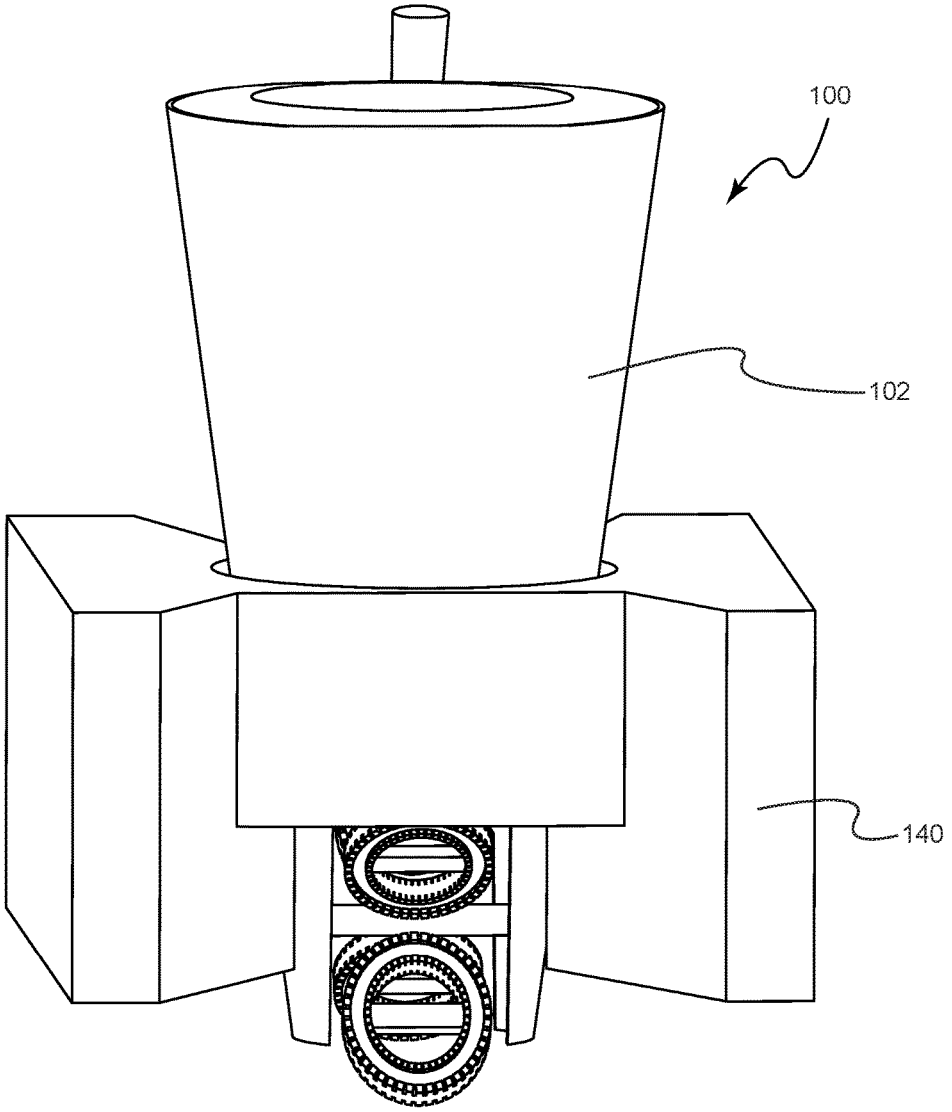
FIG. 1B is a rear view of the bubble generating article of FIG. 1A.

Referring to FIG. 1A and FIG. 1B, a bubble generating article 100 is shown in accordance with one embodiment of the invention and includes an article structure 102 and a structure support 140.

Figure 2B:
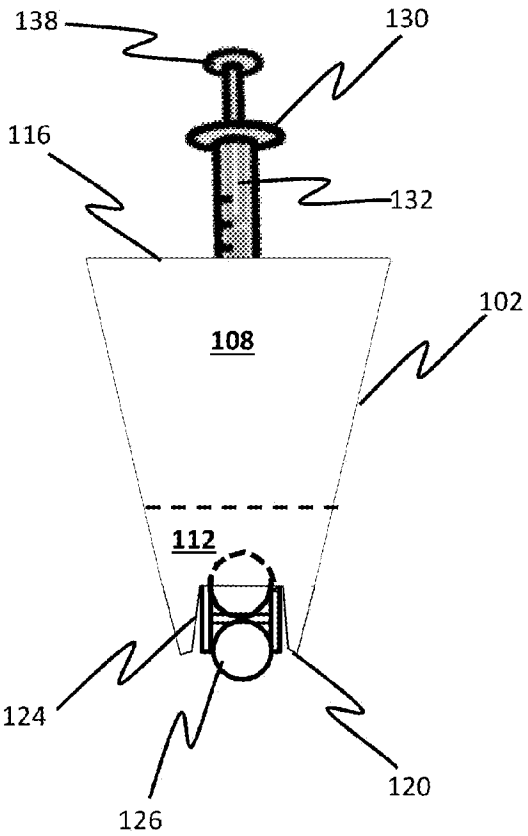
FIG. 2B is a rear view of article structure of FIG. 1A without the structure support.
Figure 2A:
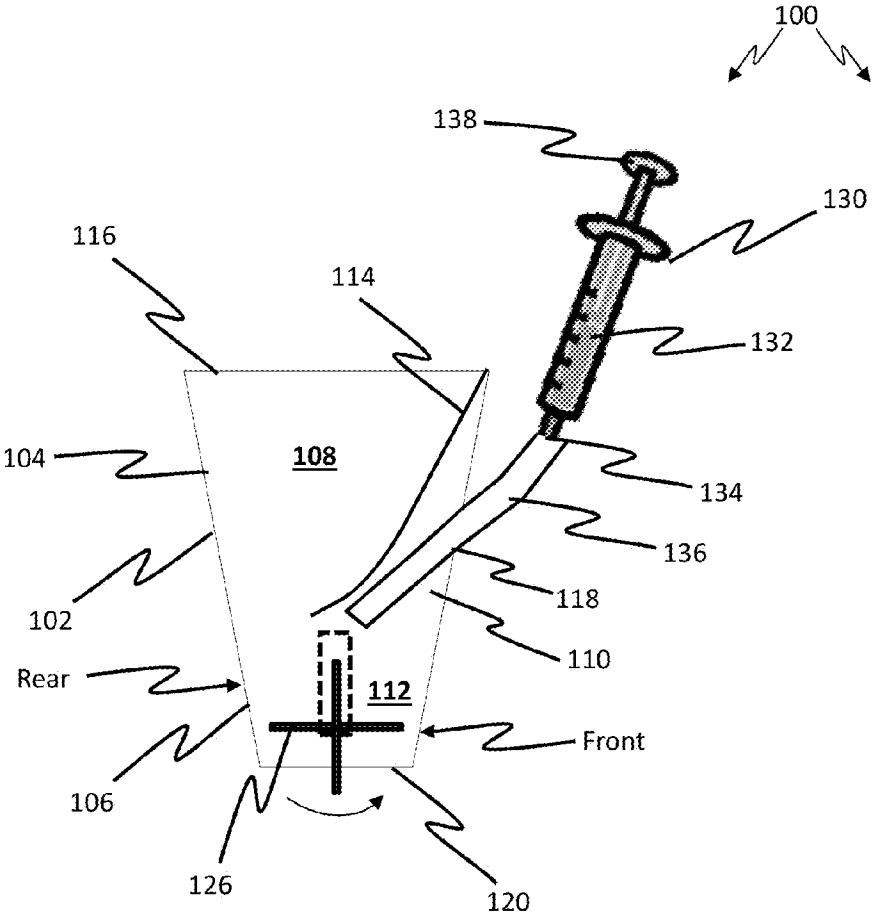
FIG. 2A is a side view of the article structure of FIG. 1A without the structure support.
Figure 2C:
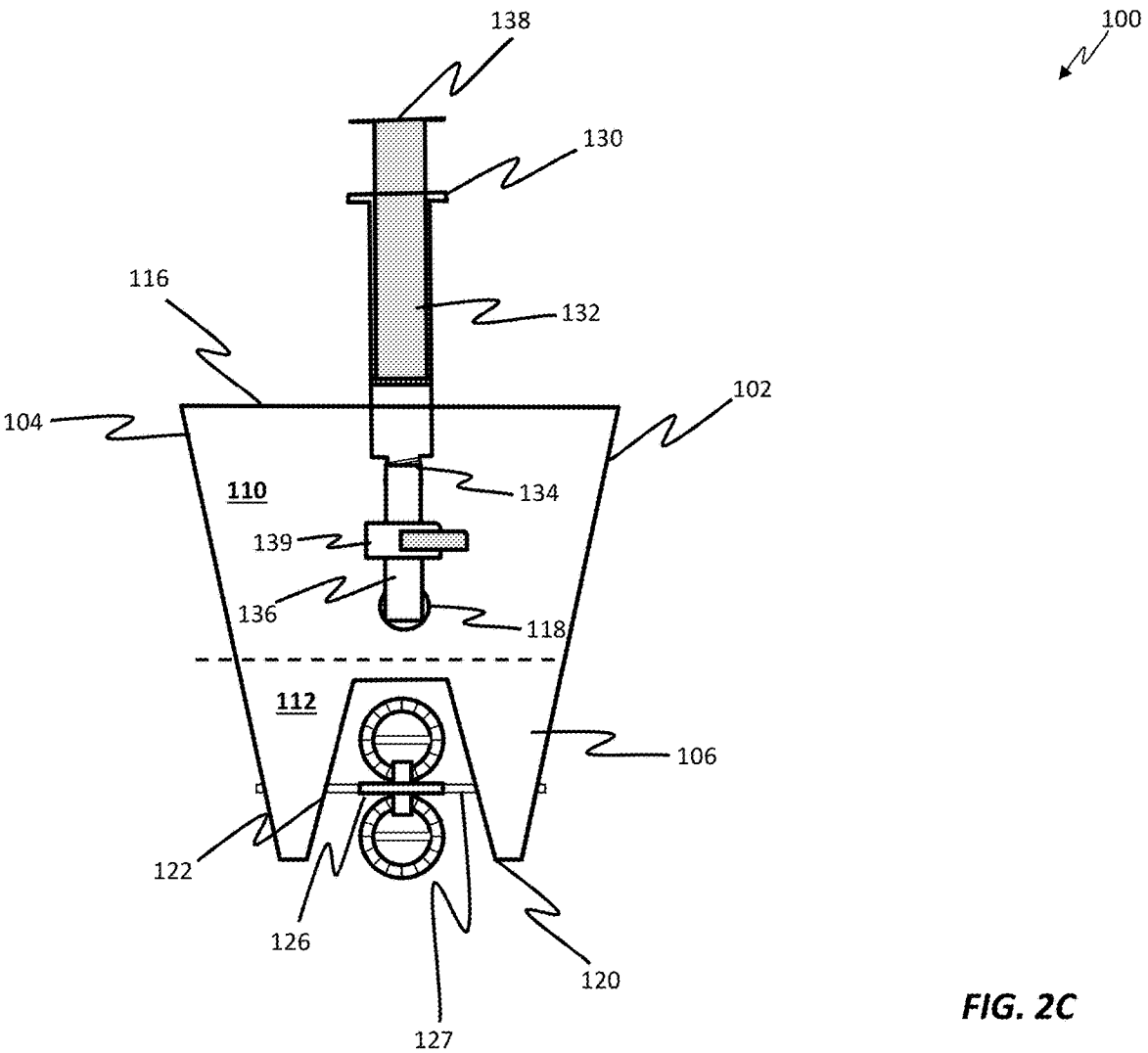
FIG. 2C is a front view of article structure of FIG. 1A without the structure support.

Referring to FIG. 2A, FIG. 2B and FIG. 2C, the article structure 102 includes an article top portion 104 and an article bottom portion 106. The article structure 102 defines a funnel shaped water receiving cavity 108, a bubble catalyst receiving cavity 110, and a mixing section 112, wherein the water receiving cavity 108 and bubble catalyst receiving cavity 110 are located proximate the article top portion 104 and are separated from each other via a separator wall 114. The article structure 102 includes a first opening 116 located proximate the article top portion 104 to be communicated with the water receiving cavity 108 and a second opening 118 located on the side wall of the article structure 102 to be communicated with the bubble catalyst receiving cavity 110. The article structure 102 further includes a structure outlet 120 located proximate the article bottom portion 106, wherein the structure outlet 120 is communicated with the mixing section 112. Additionally, the water receiving cavity 108 and the bubble catalyst receiving cavity 110 are also communicated with the mixing section 112. Referring to FIG. 2B and FIG. 2C, the structure outlet 120 includes at least one of a front outlet opening 122 and a rear outlet opening 124 to allow the bubbles that are generated to flow out of the at least one front outlet opening 122 and rear outlet opening 124.

Figures 2D, 2E:
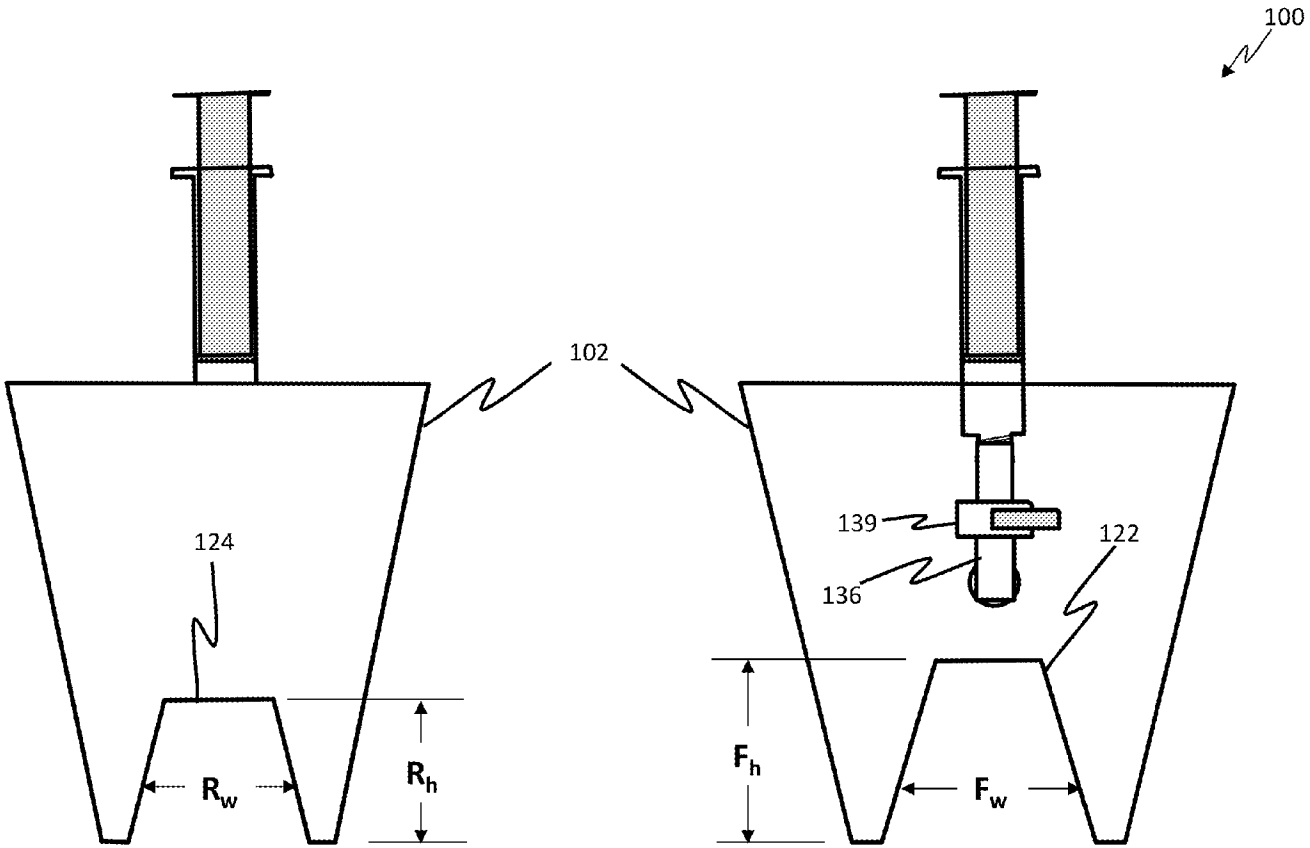
FIG. 2D is a front view of article structure of FIG. 1A without the structure support.
FIG. 2E is a rear view of article structure of FIG. 1A without the structure support.

Referring to FIG. 2D, the front opening 122 includes a front opening height $F_h$ and a front opening width $F_w$, where the front opening width $F_w$ may be fixed (i.e. of one width) or variable (as shown). Referring to FIG. 2E, the rear opening 124 includes a rear opening height $R_h$ and a rear opening width $R_w$, where the rear opening width $R_w$ may be fixed (i.e. of one width) or variable (as shown). It should be appreciated that the front opening 122 (front opening height $F_h$ and/or front opening width $F_w$) may be sized larger than the rear opening 124 as desired. Because the paddles rotate in a counter clockwise direction, this would advantageously allow bubbles generated in the bubble chamber/area to flow out of the front opening 122. It should be appreciated that the front opening width $F_w$, the front opening height $F_h$, the rear opening width $R_w$ and the rear opening height $R_h$ may be of any size suitable to the desired end purpose. It should be appreciated that the paddles may generally rotate in a counterclockwise fashion when viewed from the right side of the device and a clockwise fashion when viewed from the left side of the device.

For example, in one embodiment the front opening width $F_w$ may be about 1½ inches wide, the front opening height $F_h$ may be about 2½ inches high, the rear opening width $R_w$ may be about 1½ inches wide and the rear opening height $R_h$ may be about 1¾ inches high. Additionally, the front of the support structure 140 may include an opening that is about 3½ inches wide by about 1½ inches deep to allow a portion of the bubbles that are generated to escape upward and outward. Moreover, the rear of the support structure 140 may include an opening that is about 3 inches wide by about ½ inches deep to allow a portion of the bubbles that are generated to escape upward and outward. Also, the paddles 128, 228 may extend below the bottom of the support structure 140 by about ¼ inch to about ½ inch. It should be appreciated that the support structure 140 may be made of any material having a structural (such as density) and buoyancy characteristic suitable to the desired end purpose of floatingly supporting the article structure 102 in water. For example, the support structure 140 may be solid or hollow and may be constructed from a foam material, plastic material and/or any combination thereof. In one embodiment, the desired buoyancy may be achieved through a support structure 140 that is constructed to have a hollow buoyant plastic hull and a solid plastic keel.

Figure 3B:
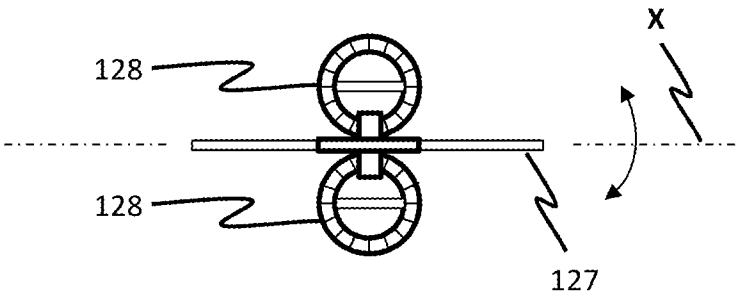
FIG. 3B is front view of the agitation device used in the bubble generating article of FIG. 1A, in accordance with one embodiment of the invention.
Figure 3A:
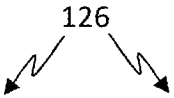
FIG. 3A is side view of the agitation device used in the bubble generating article of FIG. 1A, in accordance with one embodiment of the invention.
Figure 3A:
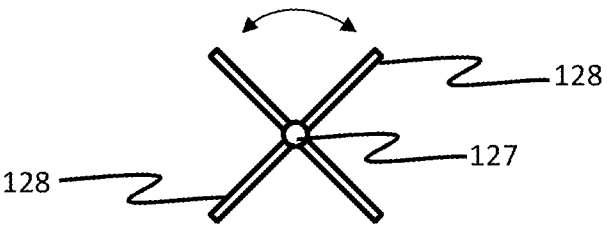
Figure 3C:
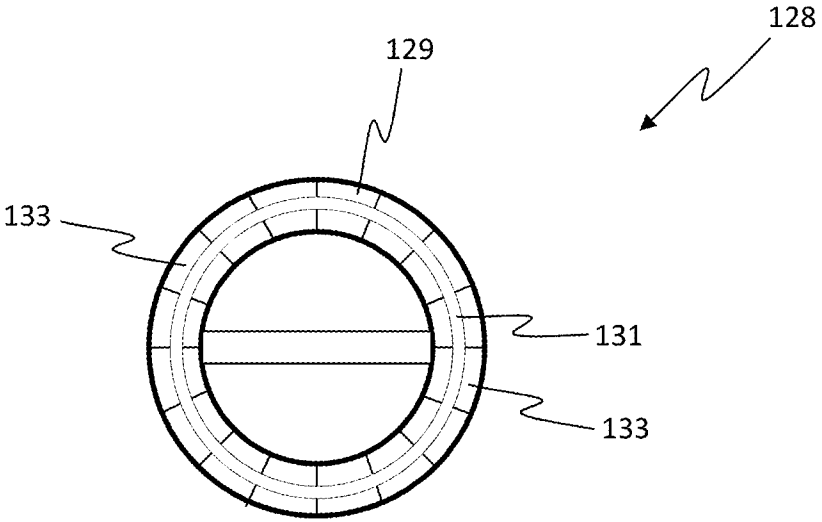
FIG. 3C is front view of a paddle used in the agitation device of FIG. 1A, in accordance with one embodiment of the invention.

The bubble generating article 100 further includes an agitation device 126 which includes a plurality of paddles 128 that are configured to rotate about an axle 127, wherein the agitation device 126 is located proximate the structure outlet 120 such that when water flows into the first opening 116, the water flows out of the structure outlet 120 thereby contacting the paddles 128 of the agitation device 126. Referring to FIG. 3A and FIG. 3B, the plurality of paddle structures 128 are rotatably connected to the agitation device 126, such that when the water contacts at least one of the plurality of paddles 128, the paddles 128 rotate about the axle 127 (such as, for example, like a water wheel). It should be appreciated that the axle 127 may be located about 60% forward of the center of the mixing area. Referring to FIG. 3C, it should be appreciated that the paddles 128 include a paddle surface 129 that has one or more channels 131 and/or grooves 133, where the one or more channels 131 and/or grooves 133 may be shaped and sized as desired.

Figure 4A:
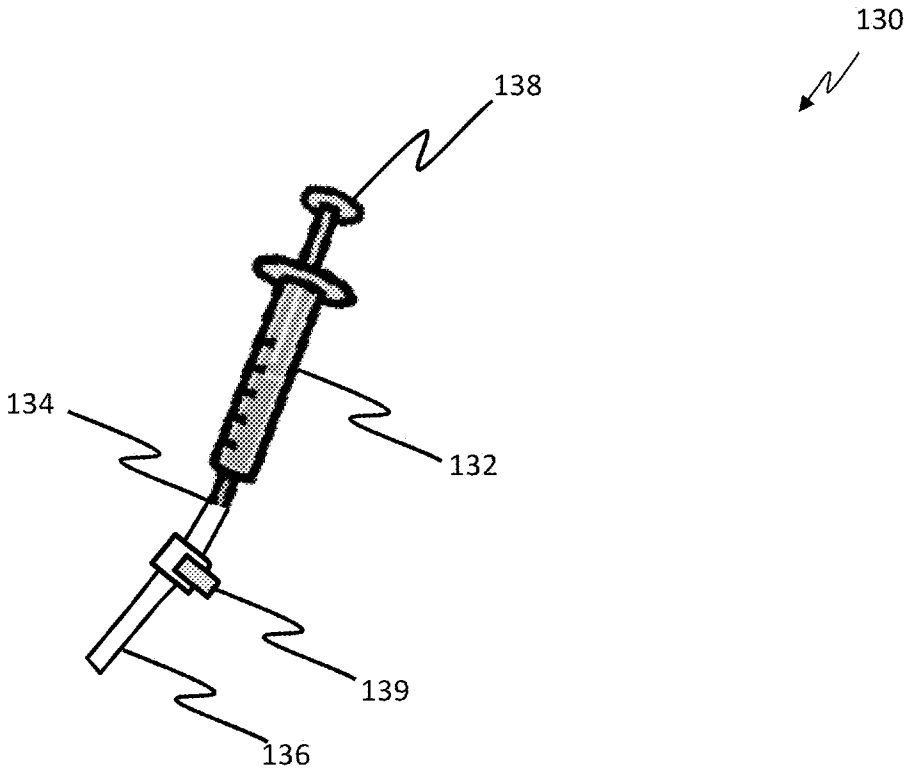
FIG. 4A is a side view of a bubble catalyst device used in the bubble generating article of FIG. 1A, in accordance with one embodiment of the invention.
Figure 4B:
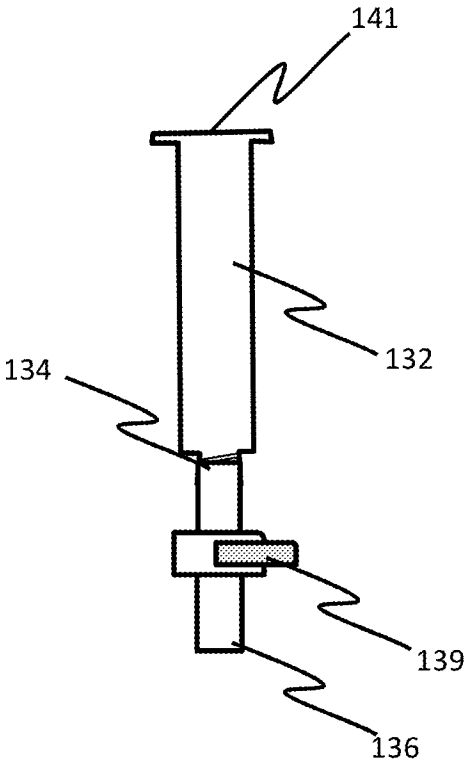
FIG. 4B is a side view of a bubble catalyst device with a vent opening, in accordance with another embodiment of the invention
Figure 5:
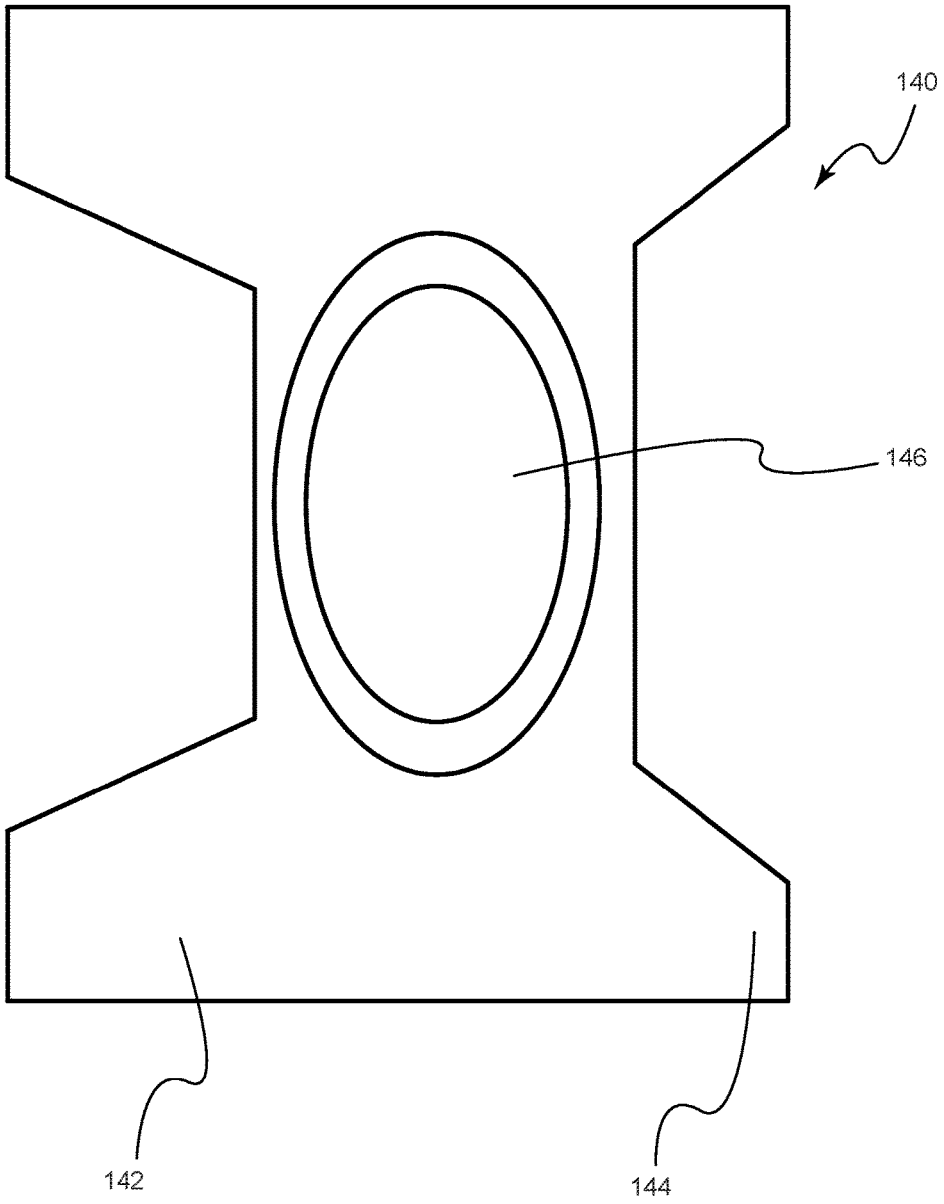
FIG. 5 is a top down view of a structure support used in the bubble generating article of FIG. 1A, in accordance with one embodiment of the invention.
Figure 6:
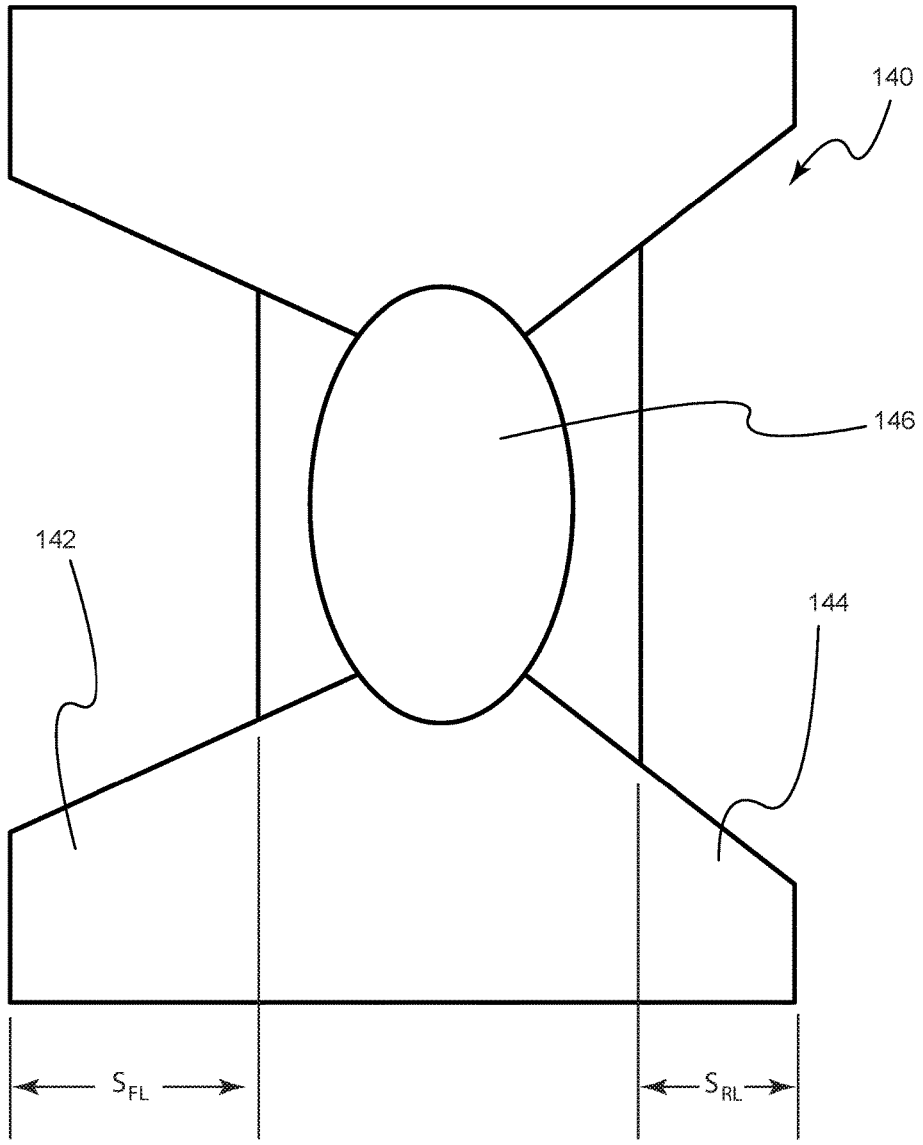
FIG. 6 is a bottom up view of the structure support of FIG. 5.
Figure 7:
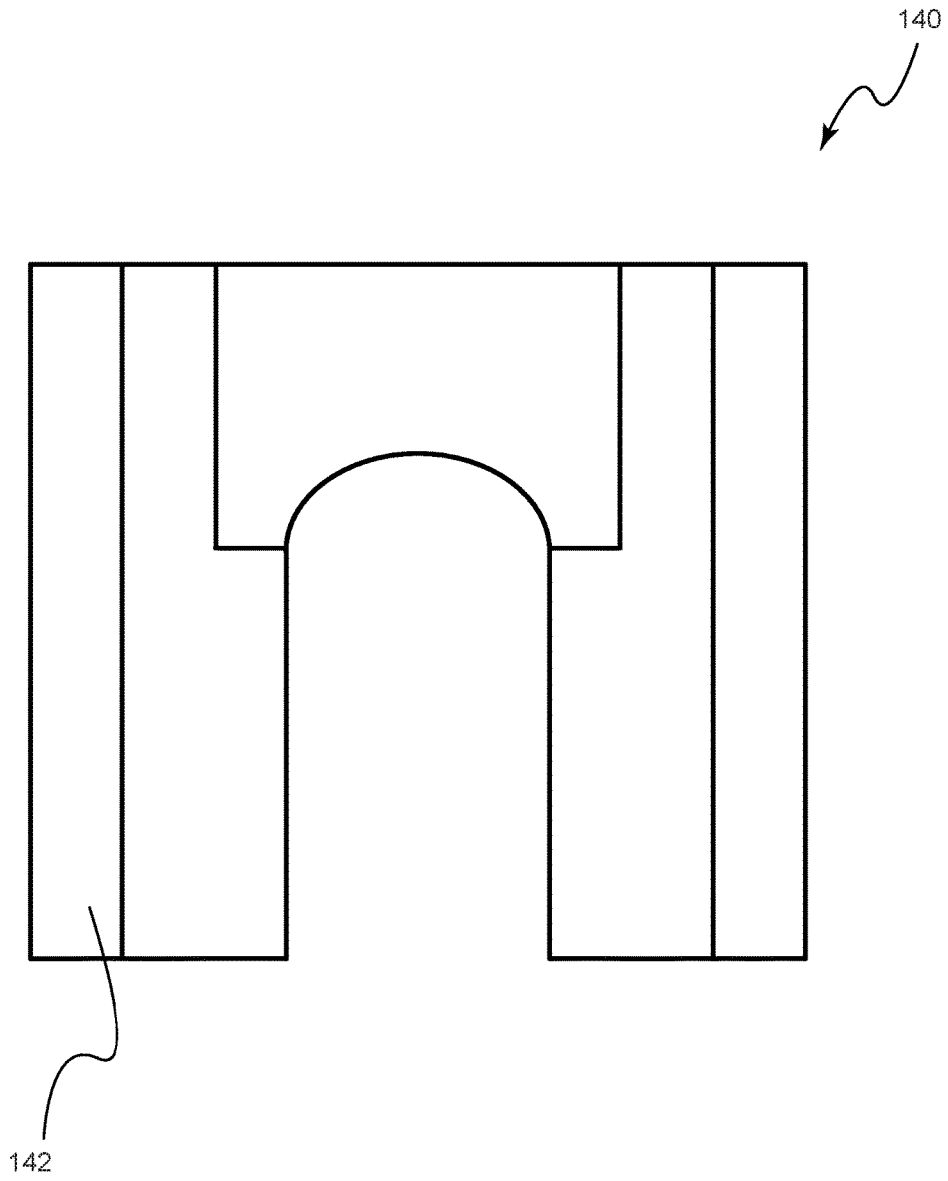
FIG. 7 is a front view of the structure support of FIG. 5.
Figure 8:
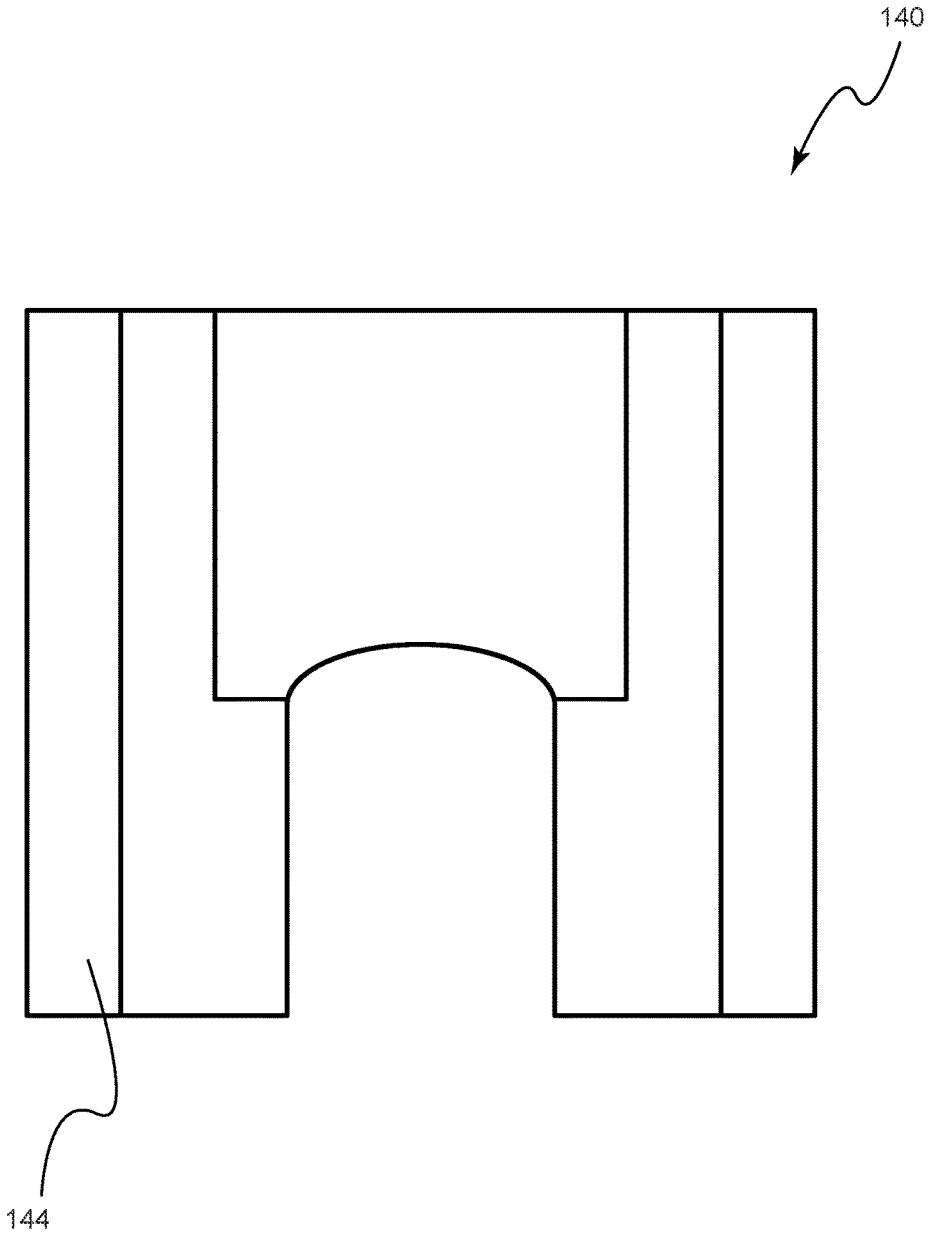
FIG. 8 is a rear view of the structure support of FIG. 5.

Referring to FIG. 4A, the bubble generating article 100 also includes a bubble catalyst device 130 having a bubble catalyst chamber 132 and a bubble catalyst chamber outlet 134, wherein the bubble catalyst chamber outlet 134 may include a catalyst tube 136 which is used to deliver the catalyst as desired. Referring to FIG. 4B, it should be appreciated that the bubble catalyst device 130 may be configured without a plunger 138 and with a vent opening 141 (which may be adjustable to control the size of the vent opening 141), where the vent opening acts to prevent a vacuum within the bubble catalyst chamber to allow bubble soap contained within the bubble catalyst chamber 132 to flow out of the bubble catalyst chamber outlet 134 via gravity and/or the bubble catalyst device 130 may also include a chamber plunger 138 which when pressed (or actuated) causes the bubble catalyst contained within the bubble catalyst chamber 132 to flow out of the bubble catalyst chamber outlet 134, through the flexible catalyst tube 136 and out of the catalyst tube 136 (which may or may not be flexible).

Additionally, the bubble catalyst device 130 may include a flow valve 139 (such as a ball valve) to control (via a metered flow) and/or stop the flow of bubble catalyst (soap) through the catalyst tube 136. Thus, the flow valve 139 may be adjusted to advantageously increase/decrease the flow rate of the bubble catalyst through the catalyst tube 136. It should be appreciated that any type of flow regulating article may be used to control the flow of soap from the bubble catalyst device 130. The bubble catalyst device 130 is associated with the bubble generating article 100 such that the bubble catalyst chamber outlet 134 is communicated with the bubble catalyst receiving cavity 110 via the catalyst tube 136. It should be appreciated that the catalyst tube 136 is communicated with the bubble catalyst receiving cavity 110, such that when bubble soap flows out of the catalyst tube 136, the bubble soap contacts the paddles 128 of the agitation device 126 when the paddles are at or proximate to the apex of their rotation about the axle 127.

Referring to FIG. 5, FIG. 6, FIG. 7 and FIG. 8, the bubble generating article 100 also includes the structure support 140 having a structure support front 142 and a structure support rear 144, wherein the structure support 140 defines an article cavity 146 for supporting the article structure 102 while the bubble generating article 100 is being used in bath water. The structure support 140 is configured to float such that only a portion of the bubble generating article 100 is disposed within the bath water. For example, in one embodiment, when the bubble generating article 100 is located within the bath water, the axle 127 of the agitation device 126 is located within the range of about 0.5 mm to 5 mm beneath the bath water line (although preferably about 1 mm or 2 mm beneath the bath water line). Additionally, in one embodiment the structure support 140 is configured using a catamaran like design which works with the front outlet opening 122 and the rear outlet opening 124 to allow bubbles that are generated to flow out of and away from the agitation device 126. It should be appreciated that the structure support front 142 includes a structure support front length $S_{FL}$ and the structure support rear 144 includes a structure support rear length $S_{RL}$, where the structure support rear length $S_{RL}$ is sized such that when the bubble generating article 100 is located beneath the faucet, the structure support rear 144 is proximate the end of the bath tub.

Figure 9B:
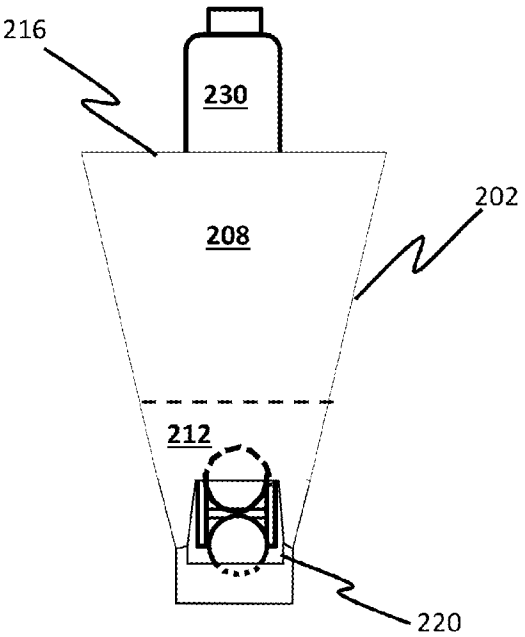
FIG. 9B is a rear view of article structure of FIG. 9A without the structure support.
Figure 9A:
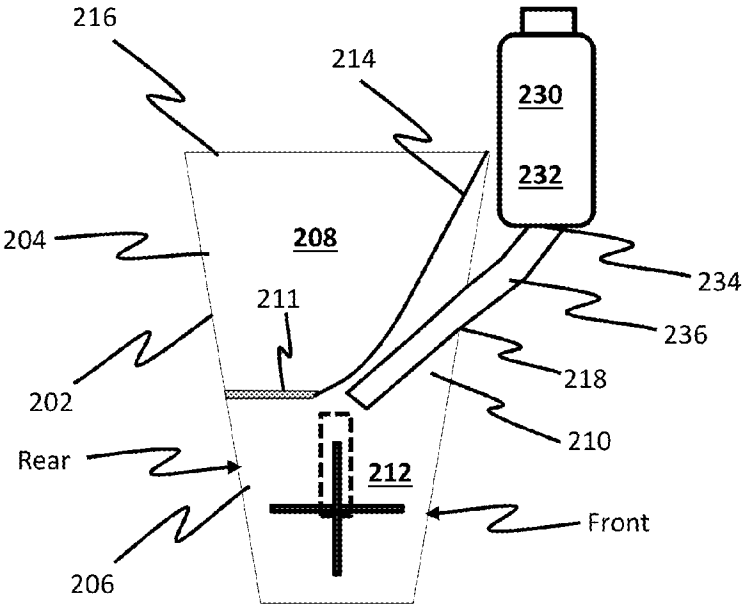
FIG. 9A is a side view of an article structure without the structure support, in accordance with another embodiment.
Figure 9C:
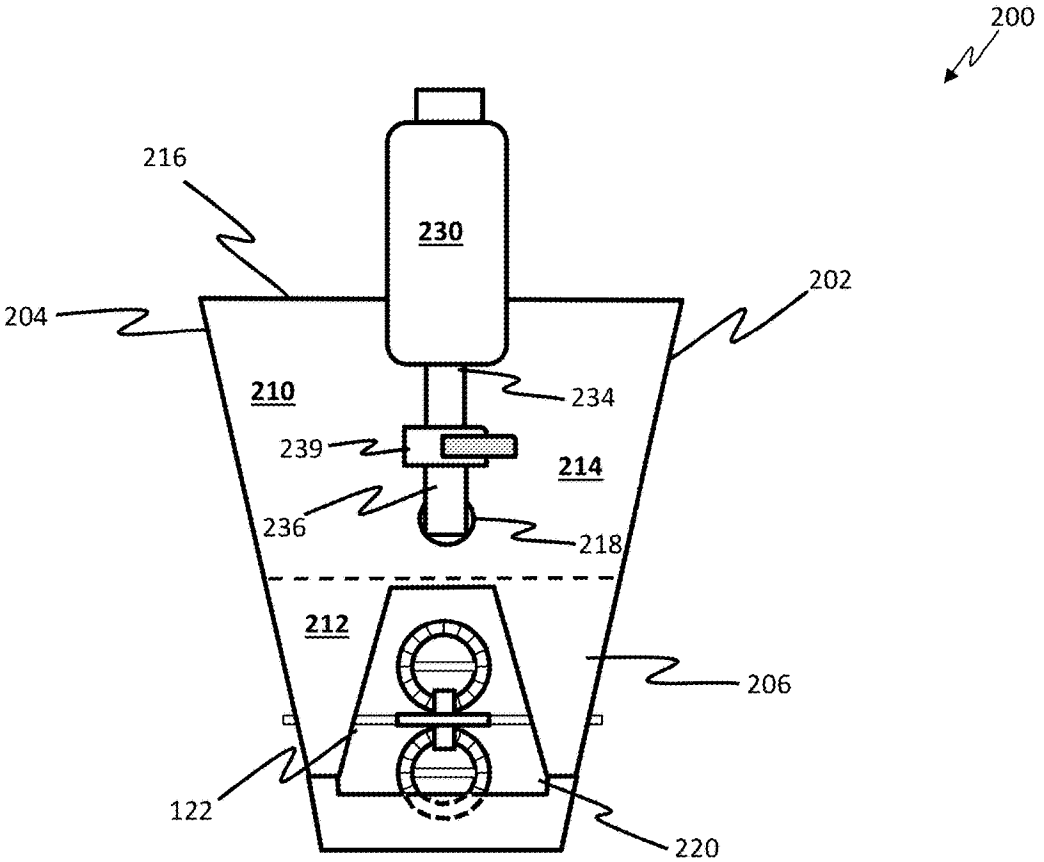
FIG. 9C is a front view of article structure of FIG. 9A without the structure support.

Referring to FIGS. 9A, 9B and 9C, a bubble generating article 200 in accordance with another embodiment of the invention is shown and includes an article structure 202 and a structure support 140.

The article structure 202 includes an article top portion 204 and an article bottom portion 206. The article structure 202 defines water receiving cavity 208 (which may be substantially funnel shaped or otherwise configured to direct water flow to a desired area of the water receiving cavity 208), a bubble catalyst receiving cavity 210, and a mixing section 212, wherein the water receiving cavity 208 and bubble catalyst receiving cavity 210 are located proximate the article top portion 204 and are separated from each other via a separator wall 214. The article structure 202 includes a first opening 216 located proximate the article top portion 204 to be communicated with the water receiving cavity 208 and a second opening 218 communicated with the bubble catalyst receiving cavity 210, wherein the article structure 202 is configured to supportingly contain or hold a bubble catalyst device 230 which contains and delivers bubble catalyst to the bubble catalyst receiving cavity 210. The article structure 202 further includes a structure outlet 220 located proximate the article bottom portion 206, wherein the structure outlet 220 is communicated with the mixing section 212.

Additionally, the water receiving cavity 208 and the bubble catalyst receiving cavity 210 are also communicated with the mixing section 212. It should be appreciated that one or more aeration screens 211 may be provided and located at the outlet of the water receiving cavity 208. These one or more aeration screens 211 are located such that the when the bubble generating article 200 is located beneath the water flowing from the water faucet, at least a portion of the water flow is incident on the one or more aeration screens 211 to change the water flow into multiple small 'tubes' or 'cylinders' of water. Essentially, air will fill the void between these several falling cylinders of water and the resulting mixture of air and water will help to produce more bubbles than a 'solid cylinder' of water alone.

Figure 10B:
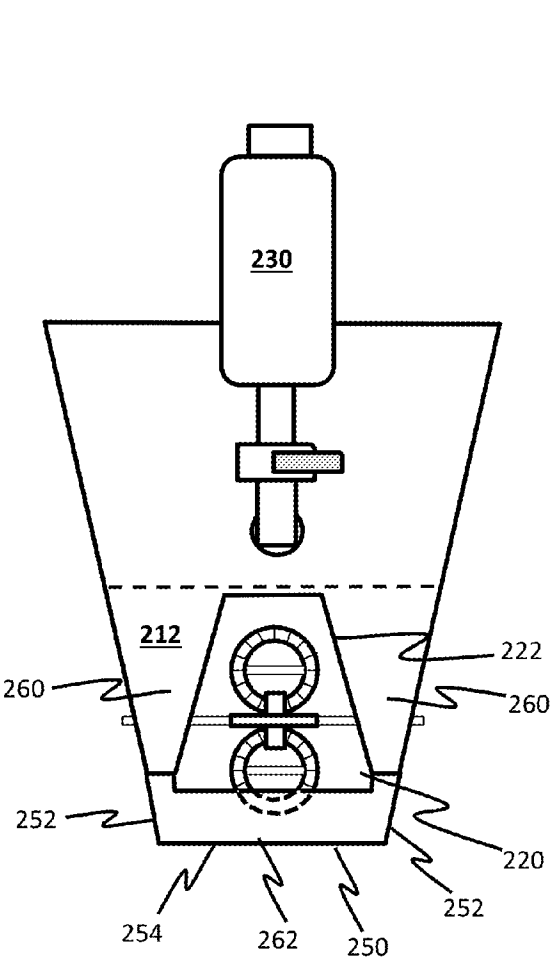
FIG. 10B is a front view of article structure of FIG. 9A without the structure support.
Figure 10A:
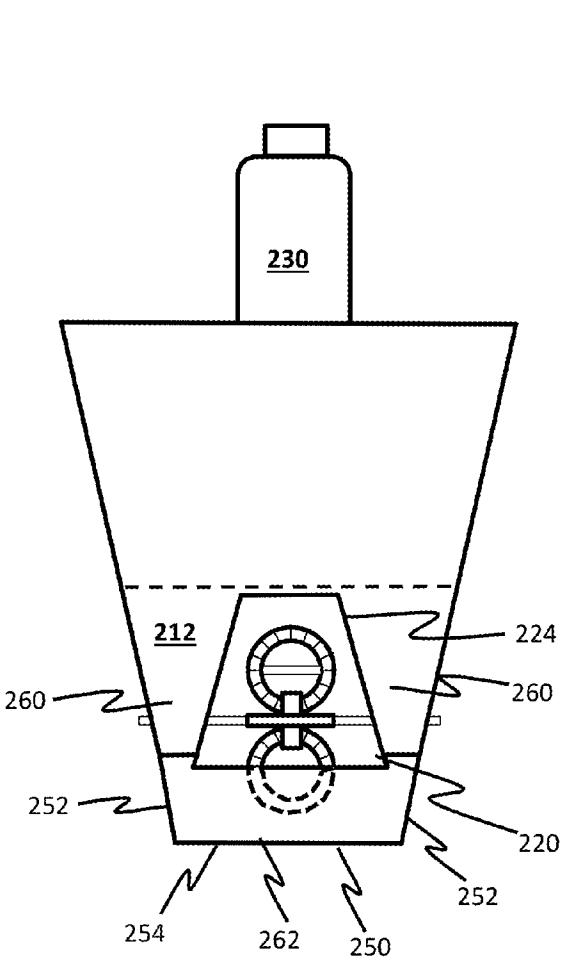
FIG. 10A is a rear view of article structure of FIG. 9A without the structure support.

Referring again to FIG. 10A and FIG. 10B, the structure outlet 220 includes at least one of a front outlet opening 222 and a rear outlet opening 224 to allow the bubbles that are generated to flow out of the at least one front outlet opening 222 and rear outlet opening 224. Moreover, the article structure 202 further includes a structure lower portion 250 having two side structures 252 and one bottom structure 254, wherein the structure lower portion 250 extends below the structure outlet 220 to define and partially enclose the mixing section 212. It should be appreciated that the side structures 252 and the bottom structure 254 may be sized and shaped to divert/channel the falling water/air/soap mixture towards the front and back of the device and out of the front and back outlet openings 222, 224. The enclosed lower portion of the agitation/aeration mixing section 212 contains the water/air/soap mixture for more time than if the mixing section 212 was not enclosed. This advantageously results in more mixing time for the water/air/soap mixture which results in more bubbles being generated. It should be appreciated that the side structures 252 and bottom structure 254 of the structure lower portion 250 also act to limit contact with the paddles 228 (by hands/feet or other structures such as the bottom of the tub) to allow the agitation device 226 to continue rotating and to protect the agitation device 226 from being handled or damaged from children playing with the bubble generating article 200. Additionally, it should be appreciated that the side structures 252 and bottom structure 254 of the structure lower portion 250 may protect the paddles 228 from damage during handling and storage outside of the bathtub. Moreover, the side structures 252 and/or bottom structure 254 may include one or more openings to allow side ward flow, if desired.

Figure 10D:
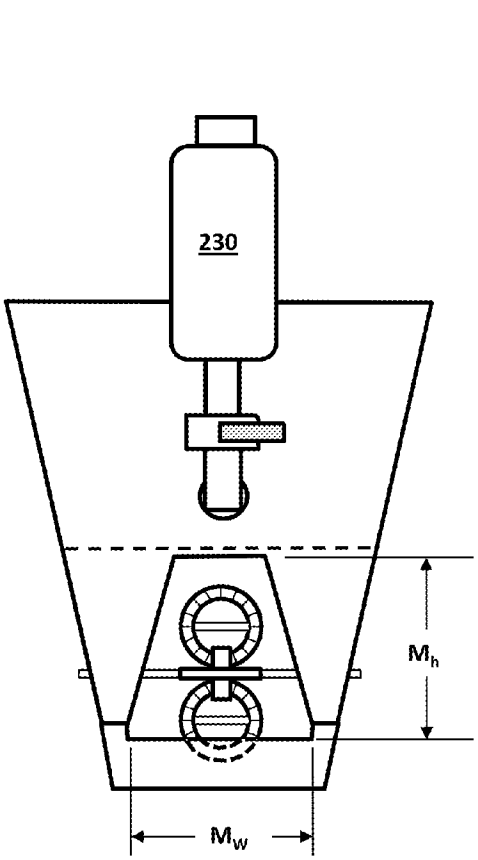
FIG. 10D is a front view of article structure of FIG. 9A without the structure support.
Figure 10C:
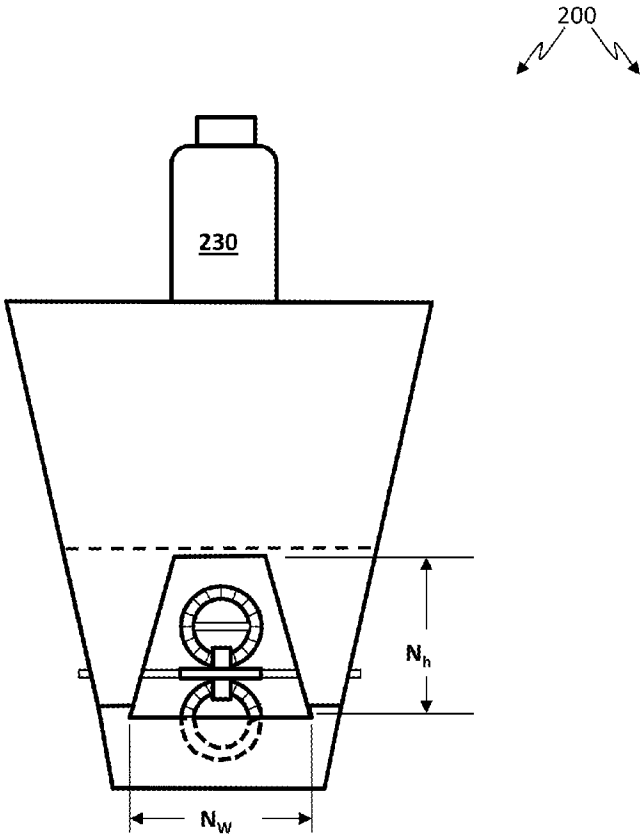
FIG. 10C is a rear view of article structure of FIG. 9A without the structure support.

Referring to FIG. 10D, the front opening 222 includes a front opening height $M_h$ and a front opening width $M_w$, where the front opening width $M_w$, may be fixed (i.e. of one width) or variable (as shown). Referring to FIG. 10C, the rear opening 224 includes a rear opening height $N_h$ and a rear opening width $N_w$, where the rear opening width $N_w$ may be fixed (i.e. of one width) or variable (as shown). It should be appreciated that the front opening 222 (front opening height $M_h$ and/or front opening width $M_w$) may be sized larger than the rear opening 224 as desired. This advantageously allows bubbles generated in the bubble mixing area to flow out of the front outlet opening 222. It should be appreciated that the front opening width $M_w$, the front opening height $M_h$, the rear opening width $N_w$ and the rear opening height $N_h$ may be of any size suitable to the desired end purpose.

For example, in one embodiment the front opening width $M_w$ may be about 1½ inches wide, the front opening height $M_h$ may be about 2½ inches high, the rear opening width $N_w$ may be about 1½ inches wide and the rear opening height $N_h$ may be about 1¾ inches high. Additionally, the front of the support structure 140 may include an opening that is about 3½ inches wide by about 1½ inches deep to allow a portion of the bubbles that are generated to escape upward and outward. Moreover, the rear of the support structure 140 may include an opening that is about 3 inches wide by about ½ inches deep to allow a portion of the bubbles that are generated to escape upward and outward. Also, the paddles 128, 228 may extend below the bottom of the support structure 140 by about ¼ inch to about ½ inch. It should be appreciated that the support structure 140 may be made of any material having a structural (such as density) and buoyancy characteristic suitable to the desired end purpose of floatingly supporting the article structure 202 in water. For example, the support structure 140 may be solid or hollow and may be constructed from a foam material, plastic material and/or any combination thereof. In one embodiment, the desired buoyancy may be achieved through a support structure 140 that is constructed to have a hollow buoyant plastic hull and a solid plastic keel.

Figure 11B:
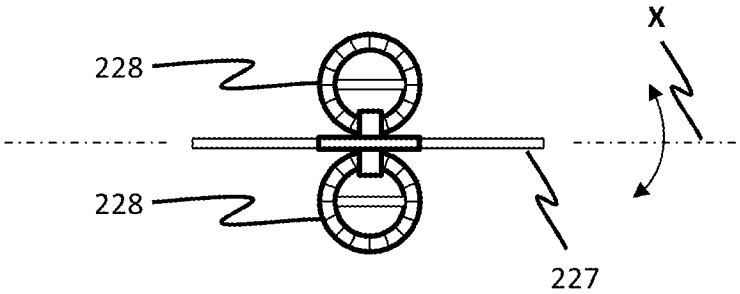
FIG. 11B is front view of the agitation device used in the bubble generating article of FIG. 9A.
Figure 11A:
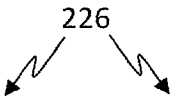
FIG. 11A is side view of the agitation device used in the bubble generating article of FIG. 9A.
Figure 11A:
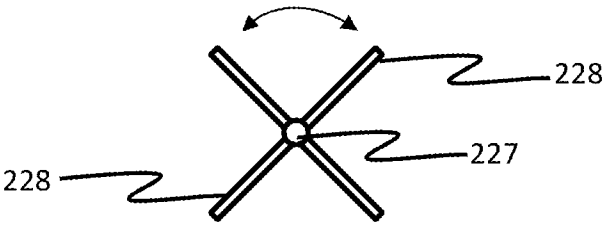

Referring to FIG. 11A and FIG. 11B, the bubble generating article 200 further includes an agitation device 226 which includes a plurality of paddles 228 that are configured to rotate about an axle 227, wherein the agitation device 226 is located proximate the structure outlet 220 such that when water flows into the first opening 216, the water flows through the one or more aeration screens 211 and out of the structure outlet 220 thereby contacting the paddles 228 of the agitation device 226. The plurality of paddle structures are rotatably connected to the agitation device 226, such that when the water contacts at least one of the plurality of paddles 228, the paddles 228 rotate about the axle 227, or the paddles 228 and axle 227 are non-movably associated such that the paddles 228 and axle 227 rotate together as one unit.

Figure 11C:
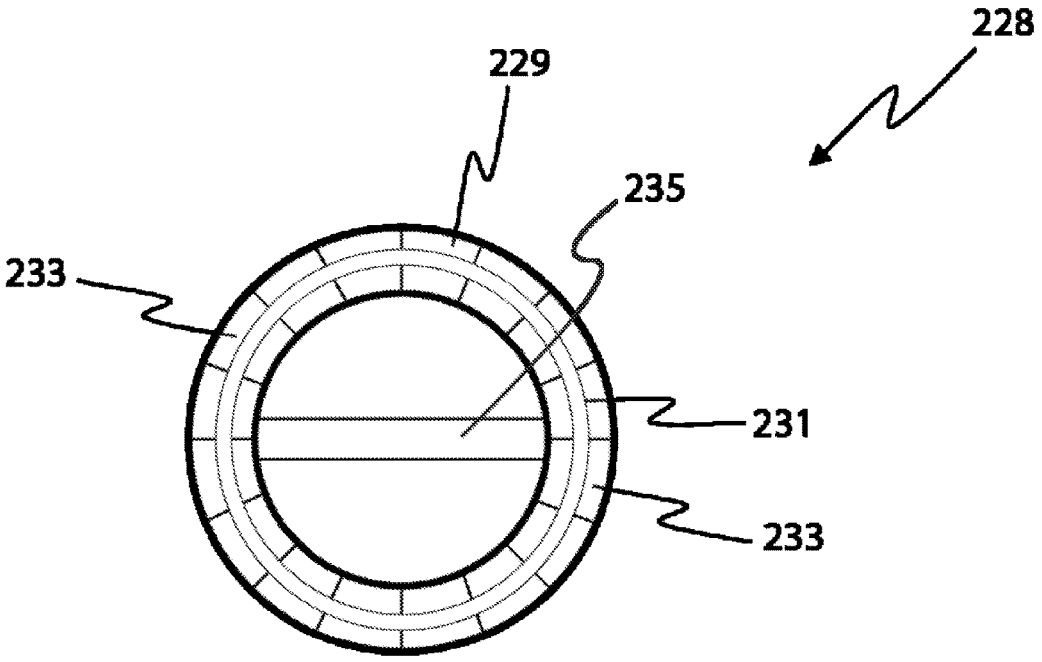
FIG. 11C is front view of a paddle used in the agitation device of FIG. 9A.

Referring to FIG. 11C, it should be appreciated that the paddles 228 are ring shaped and include a paddle surface 229 that has one or more channels 231 and/or grooves 233, where the one or more channels 231 and/or grooves 233 may be shaped and sized as desired to trap and contain small pockets of air. A cross member 235 extends across the ring-shaped paddle. It should be appreciated that one or more paddles 228 may include a concave surface and a convex surface (i.e. a "spoon shaped" portion) such that when the paddle 228 is located at just past its highest point during the rotation of the agitation device 226 (i.e. proximate the opening of the receiving cavity 108) and begins the cycle, the falling water/air mixture contacts the convex surface of the paddle 228 while the concave surface will contain a small pocket(s) of air. At this position in the rotation of the agitation device 226, the paddle 228 is above the waterline. The small pocket(s) of air will be added to the water/air/soap mixture below the waterline of the agitation device 226, thus adding air to the water/soap/air mixture to help produce a greater amount of bubbles. It should be appreciated that during rotation, the concave surface of the agitation device 226 (i.e. paddle wheel) will propel the water/air/soap mixture forward out of the front opening of the mixing section 212, thereby creating a current which will help to direct the bubbles away from the faucet end of the tub and the bubble generating device.

It should be appreciated that the paddles 228 may contain solid and open areas, wherein the solid areas will absorb the kinetic energy of the falling water, thus powering the agitation device 226 (i.e. causing the paddle wheel 226 to rotate) as well as agitating the water/air/soap mixture. The open areas of the paddles 228 will allow the paddles 228 to pass through the water/air/soap mixture more easily because there is less resistance.

Figure 12A:
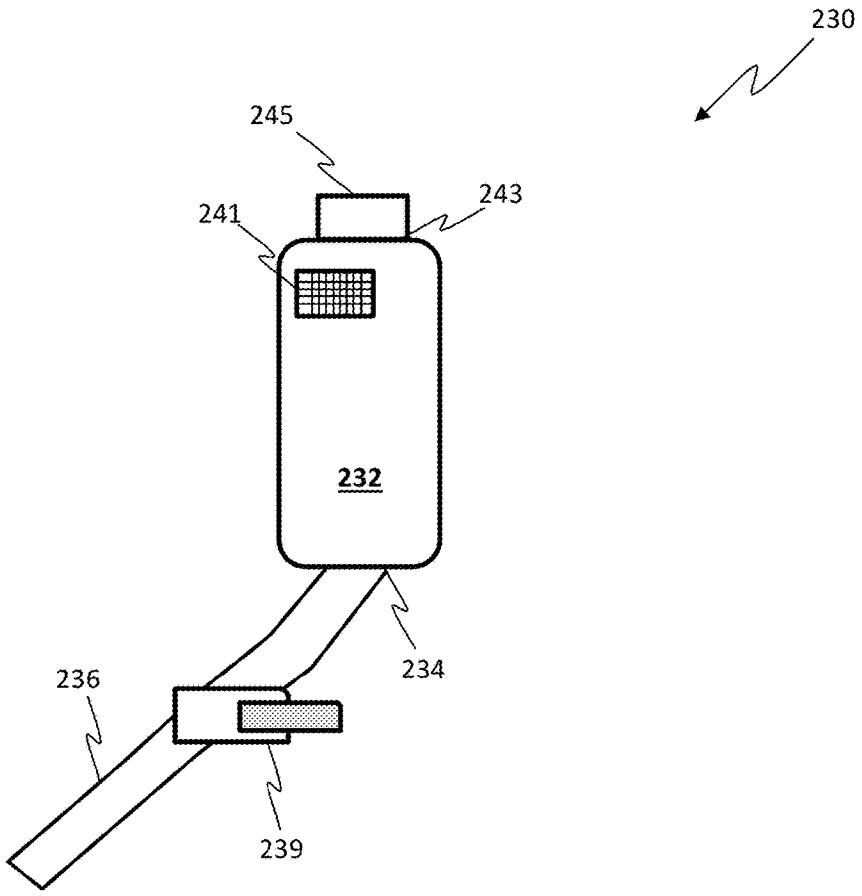
FIG. 12A is a side view of a bubble catalyst device used in the bubble generating article of FIG. 9A, in accordance with another embodiment of the invention.

Referring to FIG. 12A, the bubble generating article 200 also includes a bubble catalyst device 230 having a bubble catalyst chamber 232 and a bubble catalyst chamber outlet 234, wherein the bubble catalyst chamber outlet 234 may include a catalyst tube 236 (which may be flexible) which is used to deliver the catalyst as desired. The bubble catalyst device 230 includes a catalyst chamber inlet 243 having an inlet cover 245 and a vent opening 241 (may be adjustable if desired), where the vent opening 241 helps to control the pressure/vacuum within the bubble catalyst chamber 232 that is acting on the falling bubble soap to meter the rate of catalyst delivery. It is contemplated that in one embodiment, the vent opening 141 may be part of the catalyst chamber inlet 243 and/or the inlet cover 245. It should be appreciated that controlling the degree of vacuum of the gravity fed viscous bubble soap fluid through the narrow lumen of the catalyst tube 236 is only one method for metering the rate of bubble catalyst (i.e. soap) delivery contemplated by the invention. Other methods for metering/controlling delivery of the bubble catalyst are also contemplated.

For example, the bubble catalyst device 230 may include a flow valve 239 (such as a ball valve) to control (via a metered flow) and/or stop the flow of bubble catalyst (soap) through the catalyst tube 236. Thus, the flow valve 239 and/or the vent opening 241 may be adjusted to advantageously adjust (increase/decrease) the flow rate of the bubble catalyst through the catalyst tube 236. Moreover, it should be appreciated that any type of flow regulating article may be used to control the flow of soap from the bubble catalyst device 230. For example, some additional devices and/or methods for metering/controlling delivery of the bubble catalyst that are contemplated include controlling the pressure/vacuum through an adjustable air vent, a ball valve, a pinch clamp and/or roller clamp. As another example, one device/method for metering/controlling delivery of the bubble catalyst may include a lever that actuates a moveable door within the bubble soap tube 236 that slides open or closed to allow the soap to flow within the bubble soap tube 236. The bubble catalyst device 230 may be associated with the bubble generating article 200 such that the bubble catalyst chamber outlet 234 is communicated with the bubble catalyst receiving cavity 210 via the catalyst tube 236. It should be appreciated that the catalyst tube 236 is communicated with the bubble catalyst receiving cavity 210, such that when bubble soap flows out of the catalyst tube 236, the bubble soap contacts the paddles 228 of the agitation device 226 when the paddles 228 are located at or proximate the apex of their rotation about the axle 237.

Moreover, it is contemplated that the bubble catalyst device 130, 230 may be removable from the bubble generating article 100, 200 and the catalyst tube 136, 236 may be flanged and/or contoured to cause the bubble catalyst (i.e. bubble soap) to be dispersed over a wider area than the tube itself. For example, a ¼ inch tube may be configured to flange out to ½ inch or ¾ inch wide so the bubble catalyst drips out over a ½ inch or ¾ inch area.

Figure 12C:
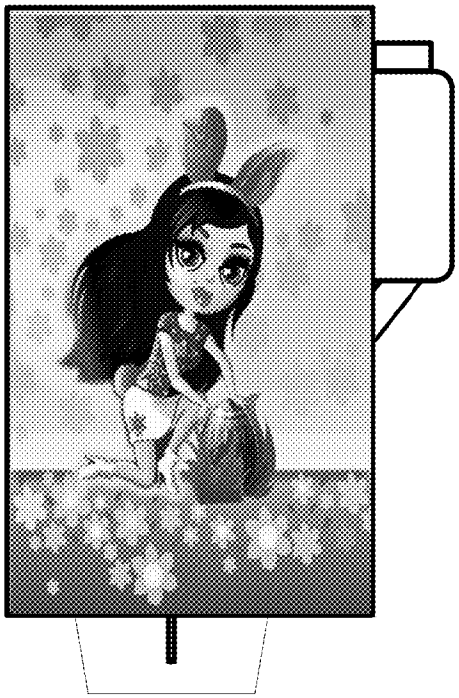
FIG. 12C is a side view of the article structure of FIG. 12B showing the design feature connected to the article structure.
Figure 12B:
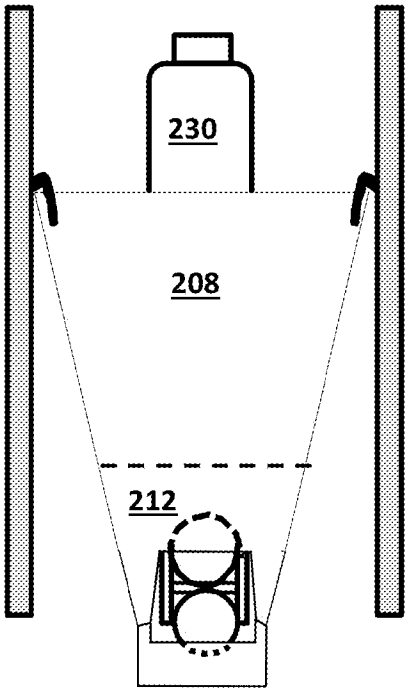
FIG. 12B is a rear view of an article structure, without the structure support, showing design features connected to the article structure in one embodiment of the invention.

It should also be appreciated that the bubble generating article 100, 200 may be configured to look like a children's cartoon character (or any other type of character as desired) or the bubble generating article 100, 200 may be configurable such that a user may configure the bubble generating article 100, 200 to resemble a desired type of character, animal or shape (such as a boat, a car, a toy, etc.) (See FIG. 12B and FIG. 12C).

Figure 13:
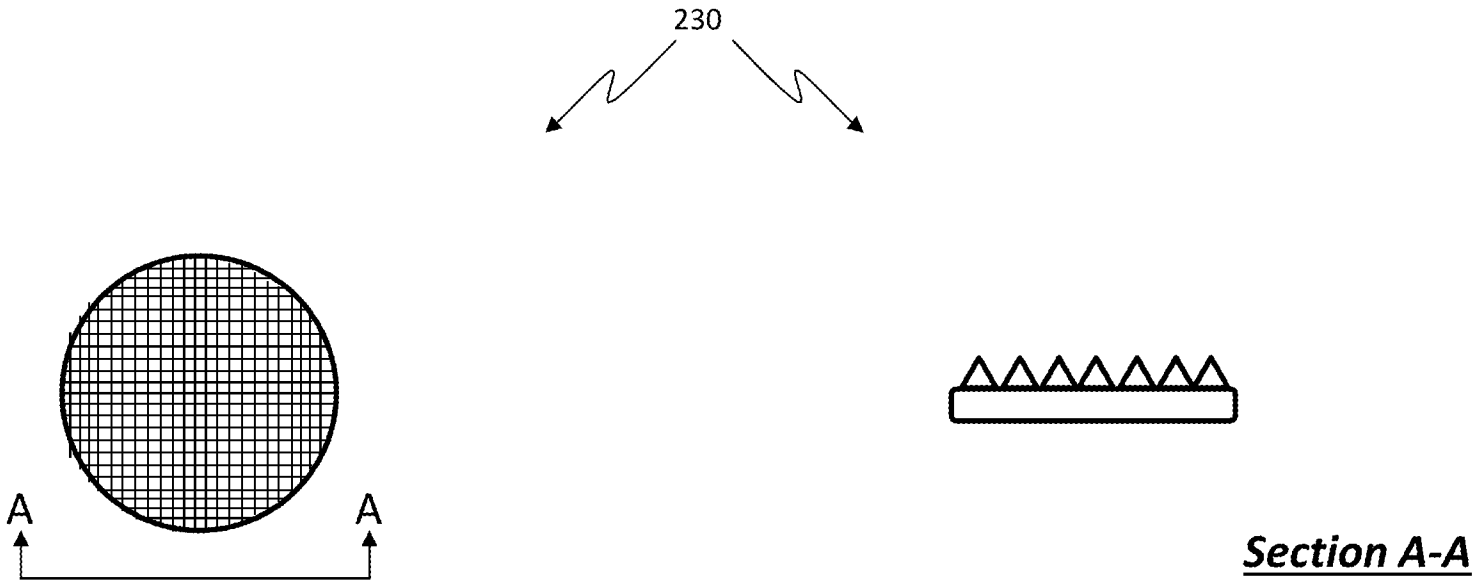
FIG. 13 is top view and a side view of an aeration screen used in the bubble generating article of FIG. 1A and/or FIG. 9A, in accordance with one embodiment of the invention.

Moreover, it is contemplated that the internal surfaces of the side structures 260 and/or bottom structure 262 may be shape and/or contoured (for example, having projections, depressions and/or surface channels) to create additional turbulence within the mixing section 212. Additionally, one or more of the aeration screens 211 may be contoured or shaped to increase the amount of air being mixed with the catalyst. FIG. 13 shows one example of a contoured aeration screen 211 which 'splits' the water flow to create pockets of air in between each 'split' section of falling water. Additionally, it is contemplated that the aeration screens 211 may be configured such that a solid form of catalyst (such as regular bar soap or a specially designed bar soap insert) may be placed on the aeration screen 211 (or surrounding sidewalls of the receiver 204) wherein bubbles are generated when the water hits the solid form of catalyst.

Figure 14:
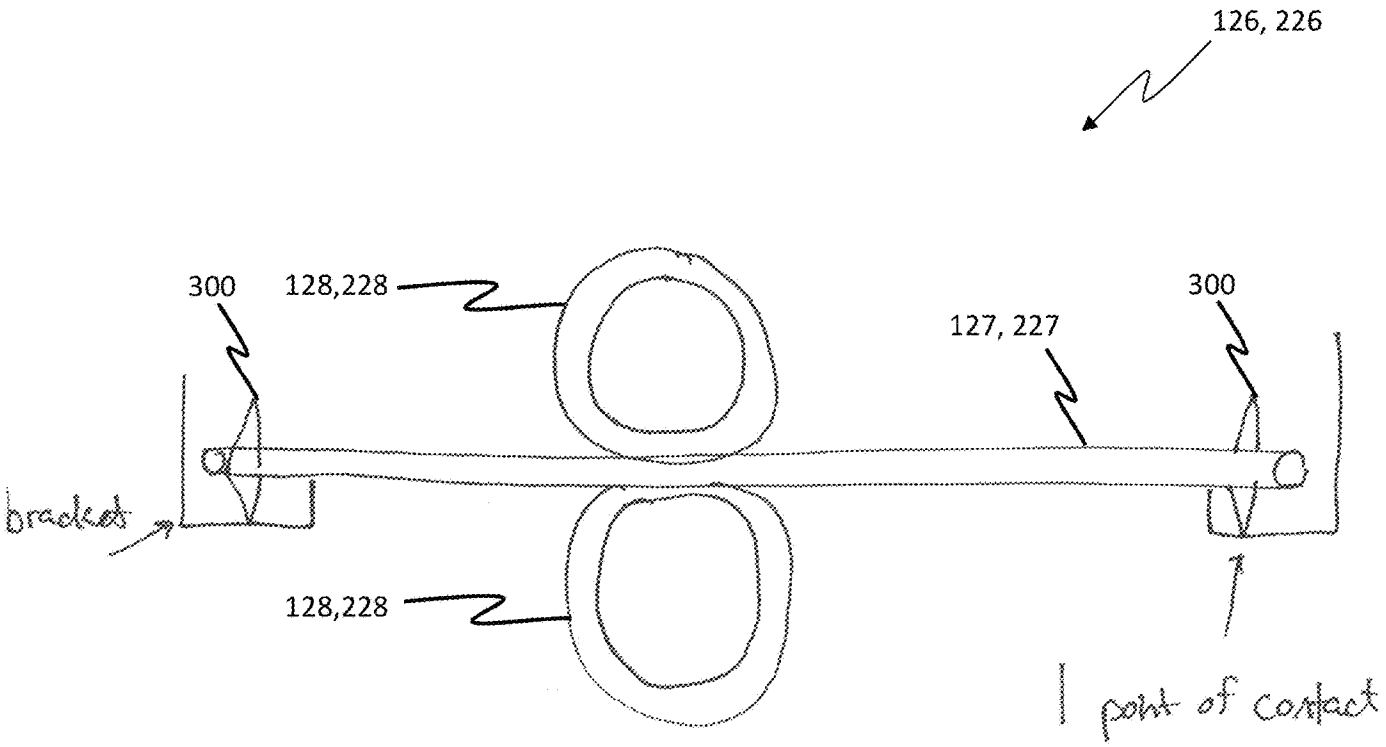
FIG. 14 is front view of the agitation device used in the bubble generating article of FIG. 9A, in accordance with another embodiment of the invention.

As discussed hereinabove, the agitation device 126, 226 includes a plurality of paddles 128, 228 that are configured to rotate about an axis X. In one embodiment, the paddles 128, 228 are movably associated with the axle 127, 227 and the paddles rotate around the axle 127, 227 (and thus axis X) while the axle remains stationary. It should be appreciated that the axle 127 may be located about 60% forward of the center of the mixing area. In another embodiment, the paddles 128, 228 are non-movably connected to the axle 127, 227 and the axle 127, 227 rotates (thereby causing the paddles 128, 228 to rotate) about the axis X. For example, referring to FIG. 14, in one embodiment the axle 127, 227 may be one solid axle with a pointed hub 300 located at each end of the axle 127, 227, where the point of each hub 300 may rest within a fastening bracket that holds the axle 127, 227 in place. In this embodiment, the pointed hub 300 allows for only a small point of contact in the fastening bracket thereby reducing the friction allowing for more revolutions per minute of the paddles 128, 228.

Moreover, it is contemplated that various paddle designs may be used. For example, referring again to FIG. 3C and FIG. 11C, one embodiment of the paddles 128, 228 is illustrated, where the paddles 128, 228 are configured to have a cross-member that divides the internal area of the paddle 128, 228 into two semi circles. It is contemplated that the paddles 128, 228 may include multiple cross-members, and/or the internal area of each paddle 128, 228 may include a plurality of openings (for example to form a "grid shaped" pattern like a 'tennis racket'). In one embodiment, the internal area of each paddle 128, 228 may be divided into 4 or 6 openings. Additionally, it is contemplated that the paddles 128, 228 may be of any shape suitable to the desired end purpose. For example, the paddles 128, 228 may be circular (as shown herein), oval, square, rectangular, oblique, convex, concave and/or any combination thereof.

Figure 16:
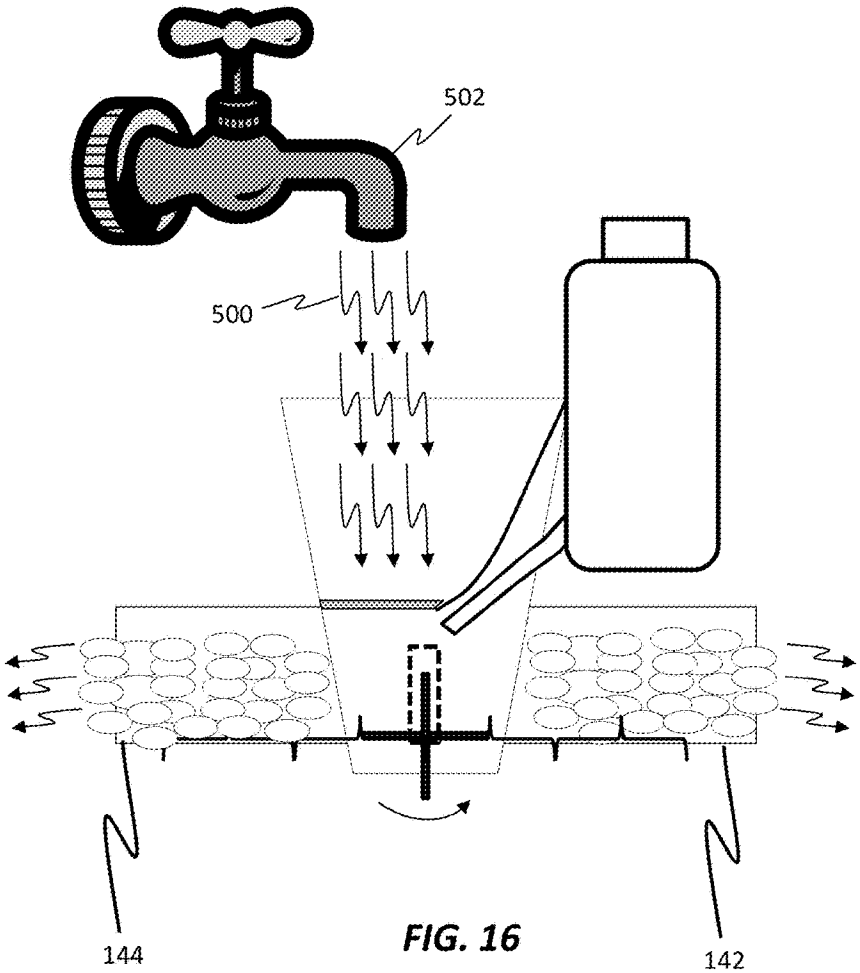
FIG. 16 is a side sectional view of the bubble generating article of FIG. 9A in operation.
Figure 15:
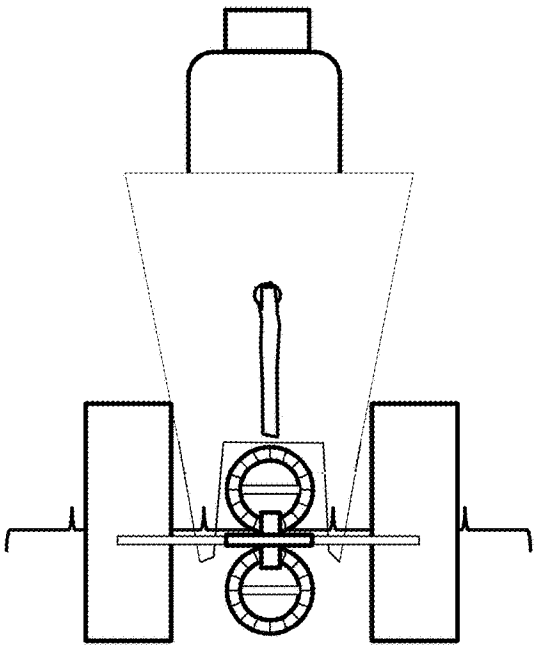
FIG. 15 is a rear sectional view of the bubble generating article of FIG. 1A in operation.

Referring to FIG. 15 and FIG. 16, the bubble generating article 100, 200 is operated as follows. The bubble generating article 100, 200 is located in the bath tub such that the water 500 from a faucet 502 flows through the first opening 116, 216 into the water receiving cavity 108, 208 and into the mixing section 112, 212 where the water contacts the plurality of paddles 128, 228 of the agitation device 126, 226 causing the plurality of paddles 128, 228 to rotate about the axis X. The bubble catalyst (i.e. bubble bath soap) flows out of the bubble catalyst chamber outlet 134, 234 (via a plunger, gravity feed, etc.) through the catalyst tube 136, 236 and exits the catalyst tube 136, 236 such that the bubble catalyst contacts the paddles 128, 228 at the point when the paddles 128, 228 are at the apex (or proximate to) of their rotation. This advantageously allows soap to gather in the one or more channels 131, 231 and/or grooves 133, 233 and directs the soap to the point of agitation. This efficient combination of metered bubble catalyst and agitation causes bubbles to be generated and directed away from the bubble generating article 100, 200 via the front outlet opening 122, 222. This is because the paddles 128, 228 are rotating about the axis X. It should be appreciated that the rotation of the plurality of paddles 128, 228 of the agitation device 126, 226 may cause the bubble generation device 100, 200 to move away from its position under the faucet 502, but this may advantageously be countered by the flow of water 500 hitting the sides of the article structure 102, 202 in the water receiving cavity 108, 208.

It should be appreciated that the bubble catalyst chamber 132, 232 may have an adjustable vent device 141, 241 and/or a flow valve 139, 239 that allows a user to choose at what rate the bubble catalyst will flow out of the bubble catalyst chamber 132, 232. For example, the vent device 141, 241 and/or the flow valve 139, 239 may be adjustable to allow the bubble catalyst to flow for a desired length of time, such as the time it takes the bath to be drawn.

It should be further appreciated that in still yet another embodiment, the bubble generating article 100, 200 may be configured without a floating support structure 140 and may be configured to be associated with a faucet such that water flowing from the faucet flows directly into the first opening 116, 216 of the article structure 102, 202 and into the water receiving cavity 108, 208. For example, in one embodiment the article structure 102, 202 may be attached to (or loosely associated with) a faucet to be located beneath the faucet opening such that water flowing out of the faucet flows the first opening 116, 216. In still yet another embodiment, the article structure 102, 202 may be attached to (or loosely associated with) a faucet such that water flowing from the faucet is directed to the first opening 116, 216.

Figure 17:
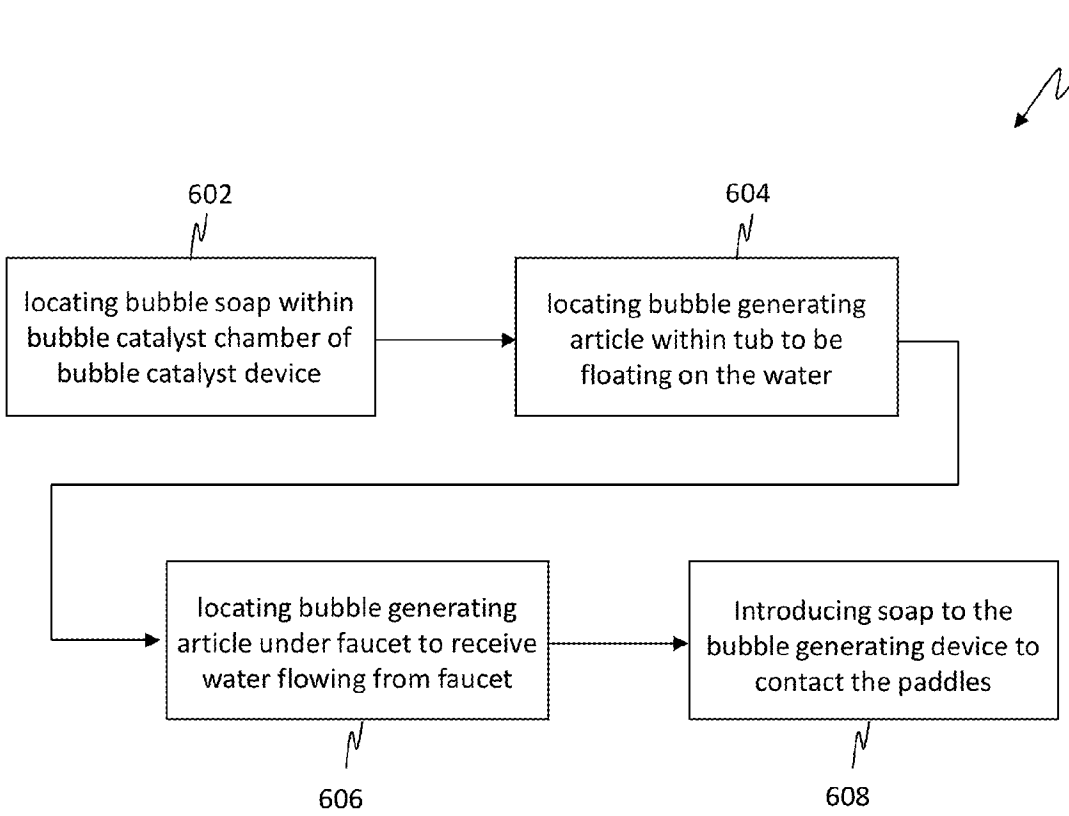
FIG. 17 illustrates a schematic block diagram illustrating a method for generating bubbles using the bubble generating article of FIG. 1A and FIG. 9A, in accordance with the present invention.

Referring to FIG. 17, a schematic block diagram is shown illustrating a method 600 for generating bubbles using a bubble generating article 100, 200 and includes locating bubble soap within the bubble catalyst chamber 132, 232 of a bubble catalyst device 130, 230 as shown in operational block 602. As the tub (or other water container) fills with water 500 (from a running faucet 502), the bubble generating article 100, 200 is located within the tub such that the bubble generating article 100, 200 is floating on the water 500 within the tub, as shown in operational block 604. The bubble generating article 100, 200 is located such that the water 500 that is flowing from the faucet 502 is flowing into the first opening 116, 216 of the article structure 102, 202 and into the water receiving cavity 108, 208, as shown in operational block 606. The water 500 flows into the mixing section 112, 212 of the article structure 102, 202 where it contacts the paddles 128, 228 of the agitation device 126, 226 thereby causing the paddles 128, 228 to rotate about the axle 127, 227 of the agitation device 126, 226.

During this time, bubble soap is flowing out of the bubble catalyst chamber 132, 232 via the catalyst tube 136, 236 to contact the paddles 128, 228 when they are at (or proximate to) the apex (i.e. top) of their rotation about the axis X, as shown in operational block 610. Because the paddles 128, 228 collects (traps) air and some of the bubble soap, the rotation of the paddles 128, 228 advantageously directs the air and bubble soap combination into the agitation and aeration bubble mixing area which is located in the area within the water proximate (i.e. around) the agitation device 126, 226.

It should be appreciated that although the article structure 102, 202 and structure support 140 are discussed herein as being two separate pieces, it is contemplated that in some embodiments, the structure support 140 may be integrated with the article structure 102, 202 (or constructed from a single piece of material) such that the structure support 140 and the article structure 102, 202 are a single piece.

Figure 18B:
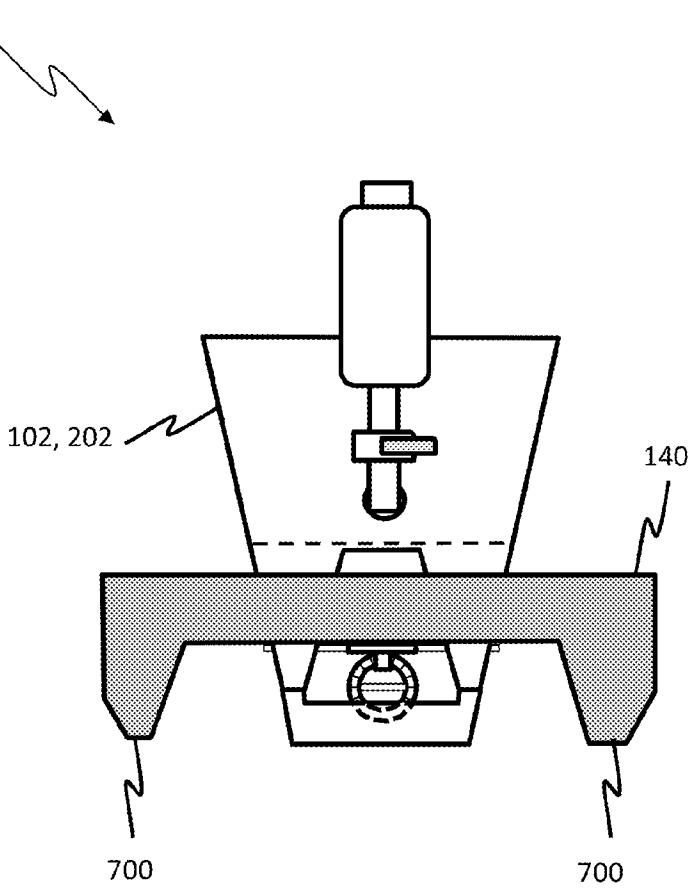
FIG. 18B is front view of the bubble generating article having multiple hulls of FIG. 18A.
Figure 18A:
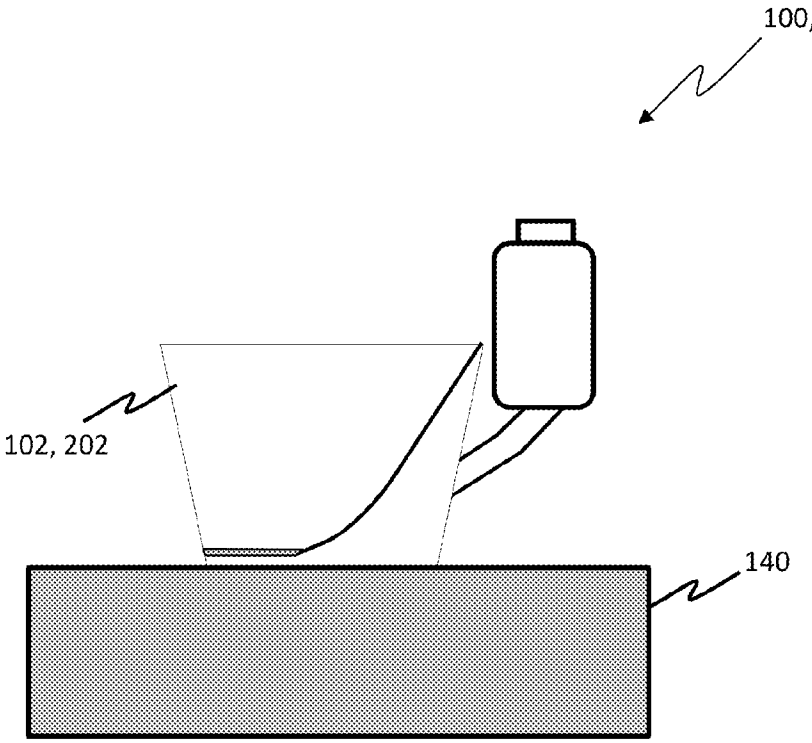
FIG. 18A is a side view of a bubble generating article having multiple hulls, in accordance with one embodiment of the invention.
Figure 19B:
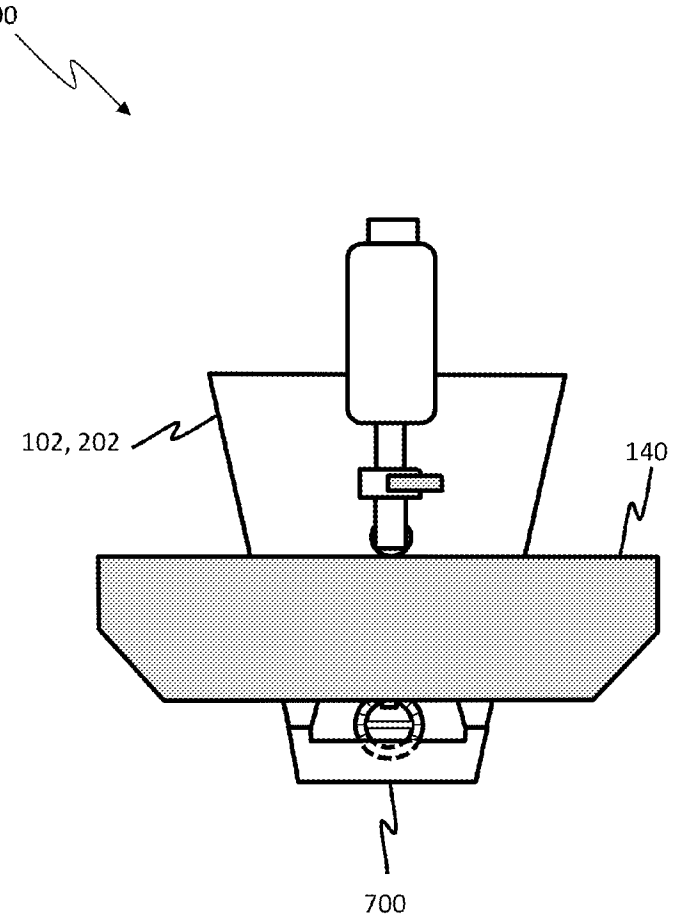
FIG. 19B is a front view of the bubble generating article having a single hull of FIG. 19A.
Figure 19A:
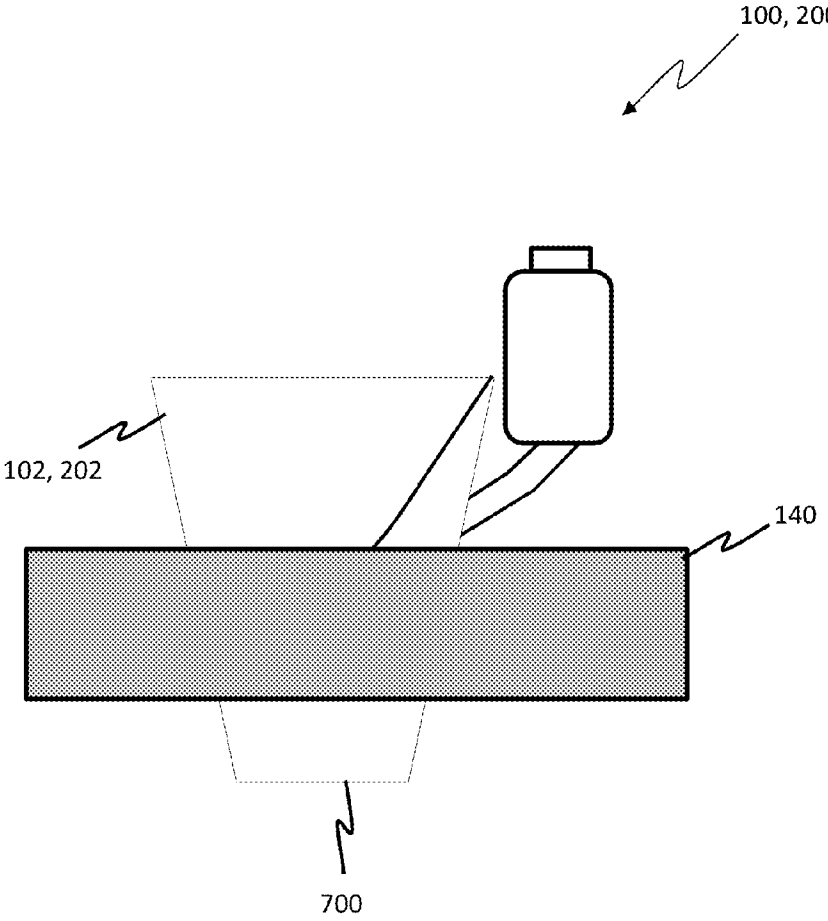
FIG. 19A is a side view of a bubble generating article having a single hull, in accordance with another embodiment of the invention.
Figure 20A:
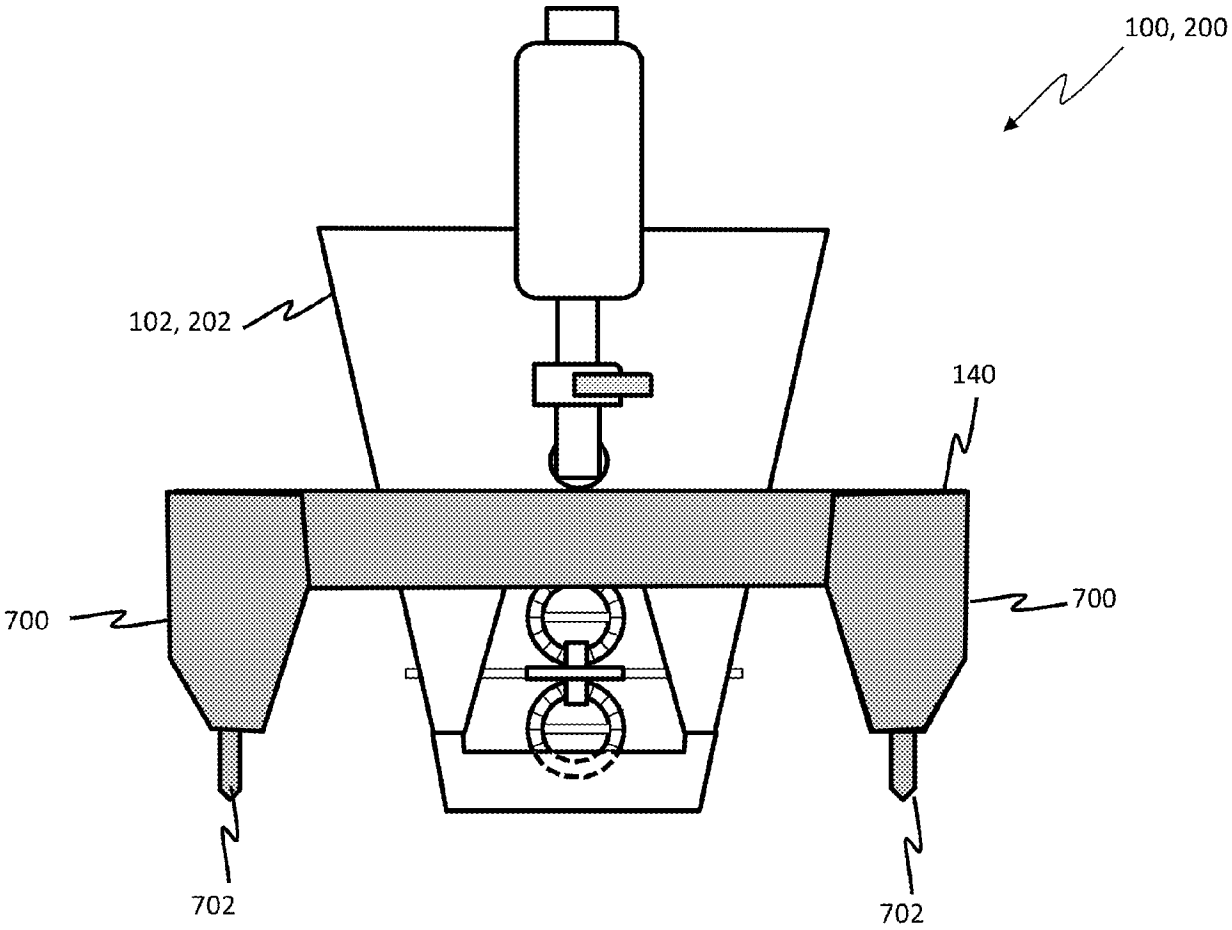
FIG. 20A illustrates a front view of the bubble generating article having multiple hulls of FIG. 18A having two keels.
Figure 20B:
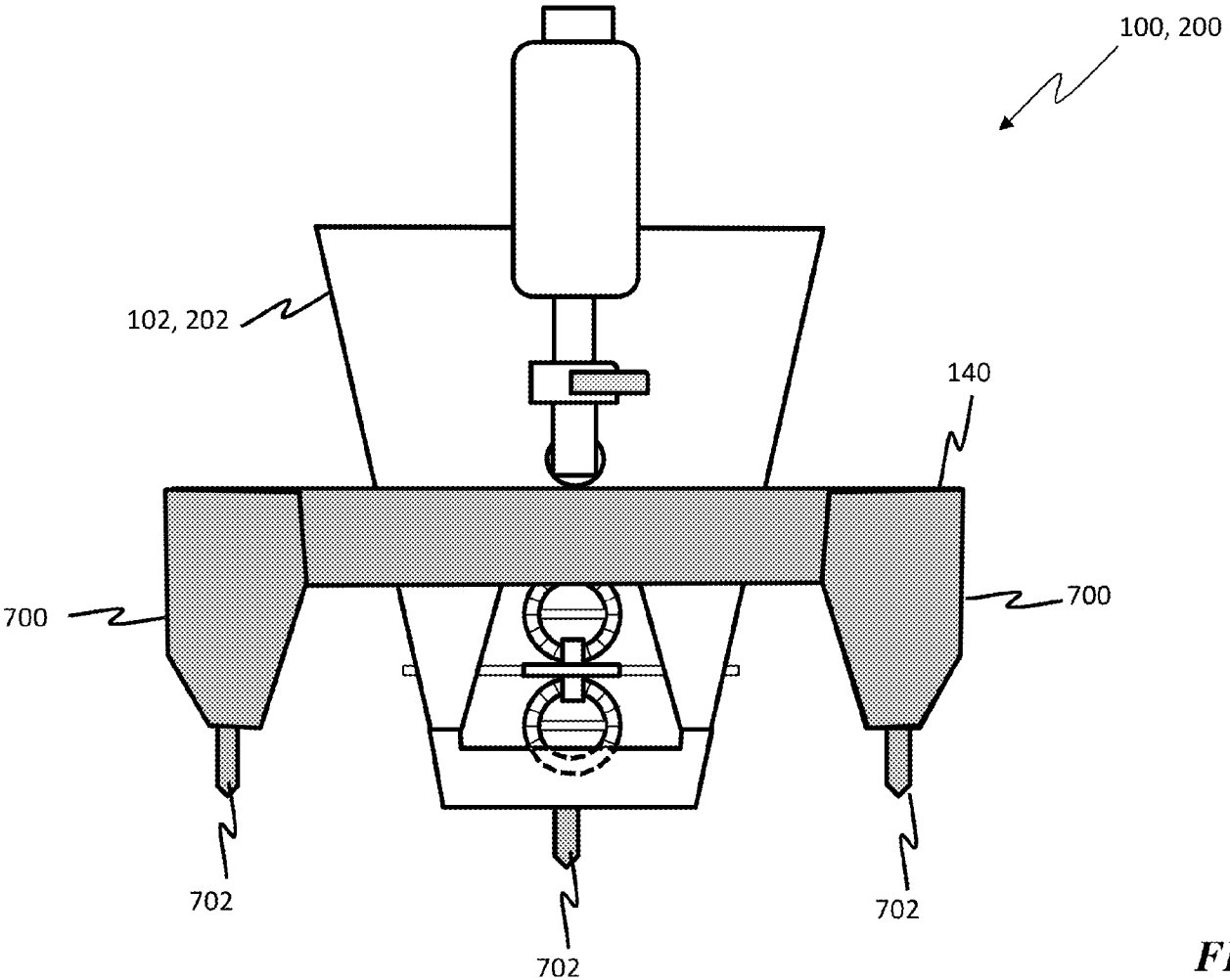
FIG. 20B illustrates a front view of the bubble generating article having multiple hulls of FIG. 18A having three keels.
Figure 20C:
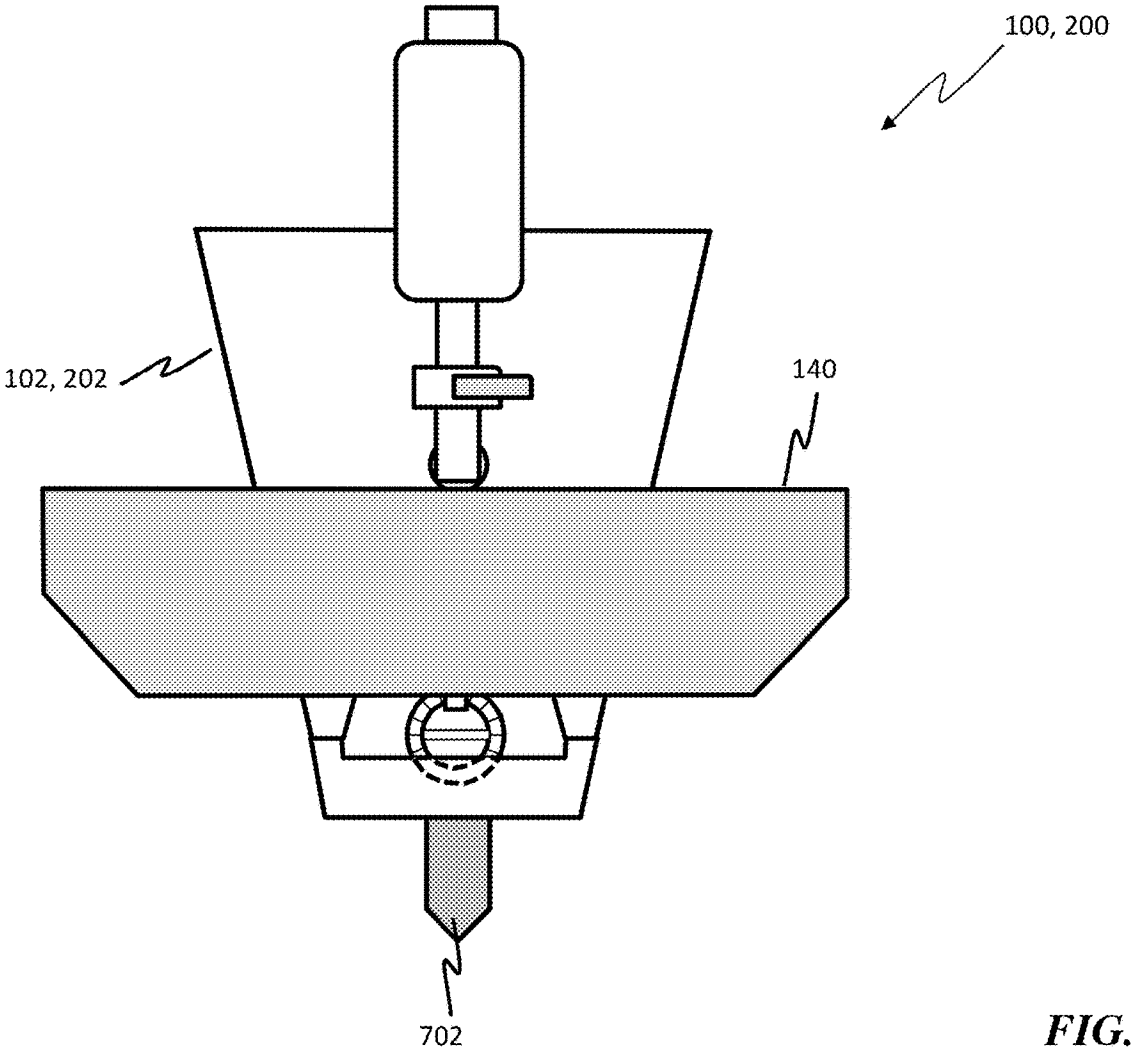
FIG. 20C illustrates a front view of the bubble generating article having a single hull of FIG. 19A having a single keels.

Referring to FIG. 18A and FIG. 18B, it should be appreciated that the bubble generating article 100, 200 of the present invention has been disclosed herein as having a support structure 140 with a double hull 700. Referring to FIG. 19A and FIG. 19B, in some embodiments of the invention a bubble generating article 100, 200 having a substantially single hull 700 is contemplated. Moreover, it is contemplated that the bubble generating article 100, 200 may include one or more keels 702 as desired wherein the keels 702 may be located on the bottom of the support structure 140 and/or the bottom of the structure lower portion 250. Referring to FIG. 20A, one embodiment of a bubble generating article 100, 200 having multiple keels 702 located on the bottom of the support structure 140 is shown. Referring to FIG. 20B, another embodiment of a bubble generating article 100, 200 having multiple keels 702 located on the bottom of the support structure 140 and the bottom of the structure lower portion 250 is shown. Referring to FIG. 20C, still yet another embodiment of a bubble generating article 100, 200 having one keel 702 located on the bottom of the structure lower portion 250 is shown.

Moreover, it should be appreciated that although the support structure 140 is shown herein with a hull having hard angles, it is contemplated that in additional embodiments the support structure 140 may have a hull (or a plurality of hulls) that is shaped to give greater stability as desired, such as being rounder with softer angles (such as being shaped like a cylindrical pontoon canoe shape or having similar shape and contour as seen in boats with hulls). This shape allows for greater hydrodynamic stability to help maintain the position of the bubble generating article 100, 200 under the flow of water from the faucet 502 against splashes and small waves created by children playing in the bathtub. It should also be appreciated that the softer contoured shape of the support structure 140 permit safer handling by children playing with the bubble generating article 100, 200 as a toy. See FIG. 20D.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A bubble generating article, comprising:

a funnel shaped body being an inverted cone having an upper opening and at least one lower opening engaged with a substantially rectangular floatation body; and the upper opening being larger than the at least one lower opening; and said upper opening is configured to receive water that is falling from a water faucet; and said at least one lower opening of said inverted cone being an outlet; and said substantially rectangular floatation body having at least one wedge shaped cut proximal to said at least one lower opening to allow fluid communication from at the at least one lower opening through said wedge shaped cut; and an aeration screen residing between said upper opening and said at least one lower opening a vessel for receiving soap having a fill port and an exit port; and said fill port of said vessel for receiving soap being external to said inverted cone; and said exit port of said vessel for receiving soap engaged with said inverted cone beneath said upper opening such that soap exiting said exit port is in fluid communication with water in said inverted cone; and an agitation device having at least three paddles configured to rotate on a horizontal axis perpendicular with respect to an imaginary axis extending from said inverted cone upper opening and lower opening; and said at least three paddles, each being ring-shaped and each having a plurality of ribs in a radial pattern on each paddle; wherein water falling from a faucet entering said upper opening of said inverted cone is in fluid communication with soap exiting said exit port of said vessel for receiving soap; and wherein a mixture of soap and water encounters and rotates said agitation device and said at least three paddles; and wherein said ribs on said paddles aerate and agitate the mixture of soap and water making bubbles that exit said at least one lower opening of said inverted cone.

2. The bubble generating article of claim 1, wherein the substantially rectangular floatation body having at least one wedge shaped cut is at least partially constructed from at least one of a foam material and a plastic material being buoyant in water such that said horizontal axis of said agitation device having at least three paddles configured to rotate on a horizontal axis is between 1 mm and 2 mm beneath a water surface that the device is floated atop.

3. The bubble generating article of claim 1, wherein each of the at least one ring-shaped paddle includes an open inner portion of the ring and at least one cross-member, wherein the at least one cross-member divides the open inner portion of the ring into at least two semi-ring shaped open inner portions.

4. The bubble generating article of claim 3, wherein the paddle interface surface includes at least one of an annular channel and a plurality of depressions.

5. The bubble generating article of claim 1, wherein the plurality of paddles include between three and eight paddles.

6. The bubble generating article of claim 1, wherein the upper opening of said inverted cone is at least partially separated from the lower opening of said inverted cone by at least one separator wall and at least one aeration screen.

7. The bubble generating article of claim 1, wherein the aeration screen is contoured in shape, the contoured screen comprising a plurality of linear members at right angles, each having a triangular cross section, pointed upward.

8. The bubble generating article of claim 1, wherein the inverted cone further includes a structure lower portion to partially enclose the lower opening, wherein the lower opening includes an open portion front, an open portion rear, a side portion of said inverted cone and a bottom structural surface.

9. The bubble generating article of claim 8, wherein an internal surface of at least one of the side portion of said inverted cone and the bottom structural surface includes at least one of projections, depressions and/or surface channels for the purpose of further aerating and mixing the fluid exiting the lower opening.

10. The bubble generating article of claim 1, wherein the vessel for receiving soap includes a metering device and dispensing tube communicated with the vessel for receiving soap, the metering device comprising a closeable opening in the vessel for receiving soap;

said closeable opening creating vacuum pressure within the vessel for receiving soap when closed, wherein the metering device is configured to adjustably control the flow of soap out of the dispensing tube and through the exit port of said vessel for receiving soap by gradually opening the closable opening.

* * * * *